US008356583B2

(12) United States Patent
Smith

(10) Patent No.: US 8,356,583 B2
(45) Date of Patent: Jan. 22, 2013

(54) VARIABLE CAMSHAFT TIMING DEVICE WITH HYDRAULIC LOCK IN AN INTERMEDIATE POSITION

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 342 days.

(21) Appl. No.: 12/921,425

(22) PCT Filed: Mar. 10, 2009

(86) PCT No.: PCT/US2009/036611

§ 371 (c)(1),
(2), (4) Date: Oct. 13, 2010

(87) PCT Pub. No.: WO2009/114500

PCT Pub. Date: Sep. 17, 2009

(65) Prior Publication Data

US 2011/0017156 A1 Jan. 27, 2011

Related U.S. Application Data

(60) Provisional application No. 61/036,119, filed on Mar. 13, 2009.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.31

See application file for complete search history.

(56) References Cited

U.S. PATENT DOCUMENTS

| | | | | |
|---|---|---|---|---|
| 5,497,738 | A * | 3/1996 | Siemon et al. | 123/90.17 |
| 5,738,056 | A | 4/1998 | Mikame et al. | |
| 6,526,930 | B2 | 3/2003 | Takahashi et al. | |
| 6,666,181 | B2 | 12/2003 | Smith et al. | |
| 6,684,835 | B2 | 2/2004 | Komazawa et al. | |
| 6,745,735 | B2 | 6/2004 | Smith | |
| 6,814,038 | B2 | 11/2004 | Smith | |
| 6,941,913 | B2 | 9/2005 | Smith | |
| 7,000,580 | B1 | 2/2006 | Smith et al. | |
| 7,240,651 | B1 | 7/2007 | Hanshaw | |

FOREIGN PATENT DOCUMENTS

| | | |
|---|---|---|
| CN | 1495344 A | 5/2004 |
| CN | 1755066 A | 4/2006 |
| CN | 101046165 A | 10/2007 |
| GB | 2437305 | 10/2007 |
| JP | 11-210424 | 8/1999 |
| JP | 2001-098910 | 4/2001 |

OTHER PUBLICATIONS

International Search Report for PCT/US2009/036611 mailed Aug. 20, 2009; 10 pgs.

* cited by examiner

*Primary Examiner* — Zelalem Eshete
(74) *Attorney, Agent, or Firm* — Brown & Michaels, PC

(57) ABSTRACT

A variable cam timing phaser for an internal combustion engine including a piloted valve in the rotor assembly, movable from a first position to a second position, and detent lines communicating with the advance chamber or the retard chamber are restricted and or blocked when the rotor assembly is in or near an intermediate phase angle position. When the piloted valve is in the first position, fluid is blocked from flowing through the piloted valve. When the piloted valve is in a second position, fluid is allowed to flow between the detent line from the advance chamber and the detent line from the retard chamber through the piloted valve and a common line, such that the rotor assembly is moved to and held in the intermediate phase angle position relative to the housing assembly.

27 Claims, 25 Drawing Sheets

VARIABLE CAMSHAFT TIMING DEVICE WITH HYDRAULIC LOCK IN AN INTERMEDIATE POSITION

BACKGROUND OF THE INVENTION

1. Field of the Invention

The invention pertains to the field of variable cam timing systems. More particularly, the invention pertains to a variable camshaft timing device with hydraulic lock in an intermediate position.

2. Description of Related Art

U.S. Pat. Nos. 6,814,038 and 6,941,913 disclose a variable cam timing system that utilizes the same spool that controls the VCT system to actively control the lock pin. The positions of the spoors lands directly influence whether source oil is supplied to both the lock pin and either the retard or the advance chamber of the phaser.

U.S. Pat. No. 6,666,181, which is hereby incorporated by reference, discloses a variable cam timing device which can be set to default in an intermediate phase angle position located between the advance and retard mechanical stops. More specifically, a hydraulic detent circuit is actuated via a control valve to command the variable cam timing (VCT) device to a position somewhere in the middle of the total phase angle range of authority.

The two features of a spool controlling the lock pin and a hydraulic detent circuit actuated via a control valve to command the VCT to a position somewhere in the middle of the total phase angle range of authority can be combined on one VCT assembly to be controlled by the spool valve, but it is not practical to do so. The problem with this approach is that there would be three hydraulic circuits on one spool valve, one to control the VCT, one to control the hydraulic detent circuit that commands the VCT to a known intermediate position and one to control the lock pin. This makes the spool valve and sleeve very long, making them very difficult to manufacture. In addition, putting all three hydraulic circuits on the control valve increases the overall package length of the VCT, which is not well received in the tight package requirements of the automotive powertrains. Finally, putting all three control circuits on one spool valve makes for complex and restrictive flow circuits, thus limiting the performance of each circuit.

GB 2437305 teaches different embodiments in which one or two locking pin are used with either a double acting spring or a hydraulic circuit under the action of cam torque reversals to return the phaser to a locked position.

In one embodiment, two one-way valves within the phaser allow oil to escape the chambers in response to torque in one direction or the other. The bores of the lock pins are each connected to one-way valves by an oil drilling that also enters the adjacent cavity formed between the housing the rotor in which the vane is present. When the phaser is unlocked and oil pressure drops, one lock pin locks the rotor relative to the housing and the other runs against the surface of the end plate. When the lock pin is locked, oil can flow through the drilling and pass through to a one-way valve to the adjacent cavity to move the phaser to a position where the second lock pin can engage and lock. If a lock pin is unlocked, the diameter of the lock pin prevents fluid from flowing to the one-way valve. This system is under passive control. In other words, another valve does not directly influence the fluid that acts on the lock pins.

In another embodiment, two one-way valves are present in the phaser and are connected to a single lock pin. A third drilling leads into the locking pin bore and this hole leads through a thin manifold plate into a slot in the front plate of the phase. The slot acts to connect the first hole to the other two holes in the manifold plate that are selectively covered and uncovered by one of the vanes. In the locked position, the vane obscures both holes. Any movement of the phase away from the locked position, allows oil to flow out of the associated cavity under the action of cam torque reversals and into the opposing set of cavities via the one-way valve. When a one-way valve is connected to the cavity, the other one-way valve is connected to the bore of the single lock pin. When the lock pin is locked, oil feed to both one-way valves is obscured to both one-way valves. When the lock pin is unlocked, oil feeds connected to the reduced diameter of the lock pin. This system is also a passive control system. In other words, a valve within the phaser or remotely does not directly influence the pressure acting on the lock pin to move it to a locked or an unlocked position.

Therefore, there is a need for a simple way of positioning the phaser in an intermediate phase angle position using an actively controlled detent piloted valve, while keeping the overall package length the same or smaller and increasing performance of the VCT phaser.

SUMMARY OF THE INVENTION

A variable cam timing phaser for an internal combustion engine including a piloted valve in the rotor assembly, movable from a first position to a second position, and detent lines communicating with the advance chamber or the retard chamber are restricted and or blocked when the rotor assembly is in or near an intermediate phase angle position. When the piloted valve is in the first position, fluid is blocked from flowing through the piloted valve. When the piloted valve is in a second position, fluid is allowed to flow between the detent line from the advance chamber and the detent line from the retard chamber through the piloted valve and a common line, such that the rotor assembly is moved to and held in the intermediate phase angle position relative to the housing assembly.

The piloted valve is moved to the first position by hydraulic pressure. The hydraulic pressure may be controlled by a remote on/off valve or the control valve of the phaser. Movement of the piloted valve to the first position is actively controlled by the remote on/off valve or the control valve of the phaser. The piloted valve is spring biased to the second position.

A lock pin may be present within the phaser. The lock pin is moved from a locked to an unlocked position by hydraulic pressure. The hydraulic pressure may be controlled by a remote on/off valve or the control valve of the phaser.

In another embodiment, when the control valve is moved to the advance, the retard, or the holding position, the lock pin moves to the unlocked position and the piloted valve is moved to the first position, blocking the flow of fluid between the advance and retard chambers through the piloted valve. When the control valve is moved to the detent position, the piloted valve is moved to the second position, the advance detent line or the retard detent line are in fluid communication with the common line through the piloted valve, the rotor assembly is moved to and held in an intermediate phase angle position relative to the housing assembly, and the lock pin is moved to a locked position.

When the phaser is in the intermediate phase position, an advance detent line and a retard detent line within the rotor may be completely blocked or substantially blocked to allow slight oscillation of the vane within the chamber formed between the housing assembly and the rotor assembly.

The lock pin may be housed in the rotor assembly and engage the housing assembly or housed in the housing assembly and engage the rotor assembly.

Alternatively, the lock pin may be formed as part of the piloted valve.

BRIEF DESCRIPTION OF THE DRAWING

FIG. 5 shows the phaser of the first embodiment of the present invention moving towards the intermediate phase angle position with the retard decent line in fluid communication with the retard chamber and the hydraulic detent circuit on.

FIG. 6 shows the phaser of the first embodiment of the present invention moving towards the intermediate phase angle position with the advance detent line in fluid communication with the advance chamber and the hydraulic detent circuit on.

DETAILED DESCRIPTION OF THE INVENTION

Figure 1:
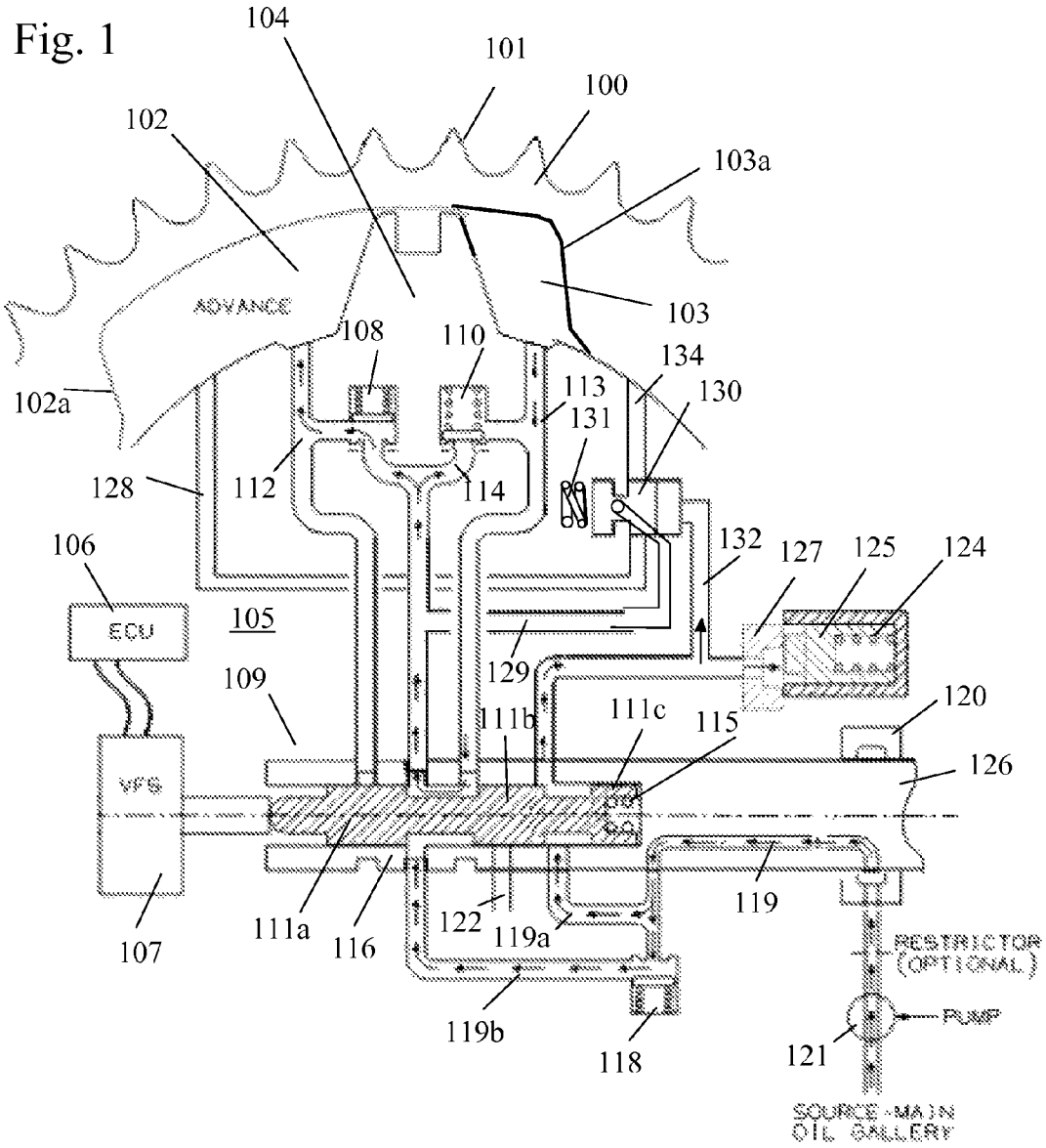
FIG. 1 shows a schematic of a first embodiment of the present invention moving towards an advance position.

In the present invention. an offset or remote piloted valve is added to the hydraulic circuit to manage the hydraulic detent switching function.

The piloted valve may be controlled on/off with the same hydraulic circuit that engages or releases the lock pin. This shortens the VCT control valve back to two hydraulic circuits versus three as discussed in the background section, a VCT control circuit and a combined lock pin/hydraulic detent control circuit. Movement of the piloted valve to the first position is actively controlled by the remote on/off valve or the control valve of the phaser.

Alternatively, a lock pin is not present and the piloted valve is controlled by a hydraulic valve means or by supply pressure through the control valve of the phaser.

One of the advantages to using the remote piloted valve is that it can have a longer stroke than the control valve, since it is not limited by a solenoid. Therefore, the piloted valve can open up a larger flow passage for the hydraulic detent mode and improve actuation rate in the detent mode. In addition, the location of the remote piloted valve shortens and simplifies the hydraulic detent circuit and thereby increases performance of the VCT detent mode or intermediate phase angle position of the phaser.

FIGS. 1-20 show the operating modes the VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor 105 with one or more vanes 104, mounted to the end of the camshaft 126, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

Referring to FIGS. 1-10 of the first embodiment, torque reversals in the camshaft caused by the forces of opening and closing engine valves move the vane 104, The advance and retard chambers 102, 103 are arranged to resist positive and negative torque pulses in the camshaft 126 and are alternatively pressurized by the cam torque. The control valve 109 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force. The rotor assembly 105 is connected to the camshaft 126 and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity. The hydraulic detent circuit 133 includes a spring 131 loaded piloted valve 130 and an advance detent line 128 that connects the advance chamber 102 to the piloted valve 130 and the common line 114, and a retard detent line 134 that connects the retard chamber 103 to the piloted valve 130 and the common line 114. The advance detent line 128 and the retard detent line 134 are a predetermined distance or length from the vane 104. The piloted valve 130 is in the rotor assembly 105 and is fluidly connected to the lock pin circuit 123 and line 119*a* through line 132. The lock pin circuit 123 includes the lock pin 125. line 132, the piloted valve 130, supply line 119*a*, and exhaust line 122.

The lock pin 125 is slidably housed in a bore in the rotor assembly 105 and has an end portion that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic detent circuit 133 and pressurization of the lock pin circuit 123 are both controlled by the switching/movement of the phase control valve 109.

A control valve 109, preferably a spool valve, includes a spool 111 with cylindrical lands 111*a*, 111*b*, and 111*c* slidably received in a sleeve 116 within a bore in the rotor 105 and pilots in the camshaft 126. One end of the spool contacts spring 115 and the opposite end of the spool contacts a pulse width modulated variable force solenoid (NTS) 107. The solenoid 107 may also be linearly controlled by varying current or voltage or other methods as applicable. Additionally, the opposite end of the spool 111 may contact and be influenced by a motor, or other actuators.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the lock pin circuit 123 and the hydraulic detent circuit 133 are open (on) or closed (off). In other words, the position of the spool 111 actively controls the piloted valve. The control valve 109 has an advance mode, a retard mode, a null mode, and a decent mode. In the advance mode, the spool 111 is moved to a position so that fluid may flow from the retard chamber 103 through the spool 111 to the advance chamber 102, fluid is blocked from exiting the advance chamber 102, and the detent valve circuit 133 is off or closed. in the retard mode, the spool 111 is moved to a position so that fluid may flow from the advance chamber 102 through the spool 111 to the retard chamber 103, fluid is blocked from exiting the retard chamber 103, and the detent valve circuit 133 is off In null mode, the spool 111 is moved to a position that blocks the exit of fluid from the advance and retard chambers 102, 103, and the detent valve circuit 133 is off In the detent mode, three functions occur simultaneously. The first function in the detent mode is that the spool 111 moves to a position in which spool land 111*b* blocks the flow of fluid from line 112 in between spool lands 111*a* and 111*b* from entering any of the other lines and line 113, effectively removing control of the phaser from the control valve 109. The second function in detent mode is to open or turn on the detent valve circuit 133. The detent valve circuit 133 has complete control over the phaser moving to advance or retard, until the vane 104 reaches the intermediate phase angle position. The third function in the detent mode is to vent the lock pin circuit 123, allowing the lock pin 125 to engage the recess 127. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 30%, 50% or 100%, the spool 111 will be moved to positions that correspond with the retard mode, the null mode, and the advance mode, respectively and the piloted valve 130 will be pressurized and move to the second position, the hydraulic detent circuit 133 will be closed, and the lock pin 125 will be pressurized and released. When the duty cycle of the variable force solenoid 107 is 0%, the spool 111 is moved to the detent mode such that the piloted valve 130 vents and moves to the second position, the hydraulic detent circuit 133 will be open, and the lock pin 125 vented and engaged with the recess 127. A duty cycle of 0% was chosen as the extreme position along the spool stroke to open the hydraulic detent circuit 133, vent the piloted valve 130, and vent and engage the lock pin 125 with the recess 127, since if power or control is lost, the phaser will default to a locked position. It should be noted that the duty cycle percentages listed above are an example and they may be altered. Furthermore, the hydraulic detent circuit 133 may be open, the piloted valve 130 vented, and the lock pin 125 vented and engaged with the recess 127 at 100% duty cycle, if desired.

FIG. 1 shows the phaser moving towards the advance position. To move towards the advance position, the duty cycle is increased to greater than 50% and up to 100%, the force of the VFS 107 on the spool 111 is increased and the spool 111 is moved to the right by the VFS 107 in an advance mode, until the force of the spring 115 balances the force of the VFS 107. In the advance mode shown, spool land 111*a* blocks line 112 and lines 113 and 114 are open. Camshaft torque pressurizes the retard chamber 103, causing fluid to move from the retard chamber 103 and into the advance chamber 102, and the vane 104 to move in the direction shown by the arrow. Fluid exits from the retard chamber 103 through line 113 to the control valve 109 between spool lands 111*a* and 111*b* and recirculates back to central line 114 and line 112 leading to the advance chamber 102.

Figure 10:
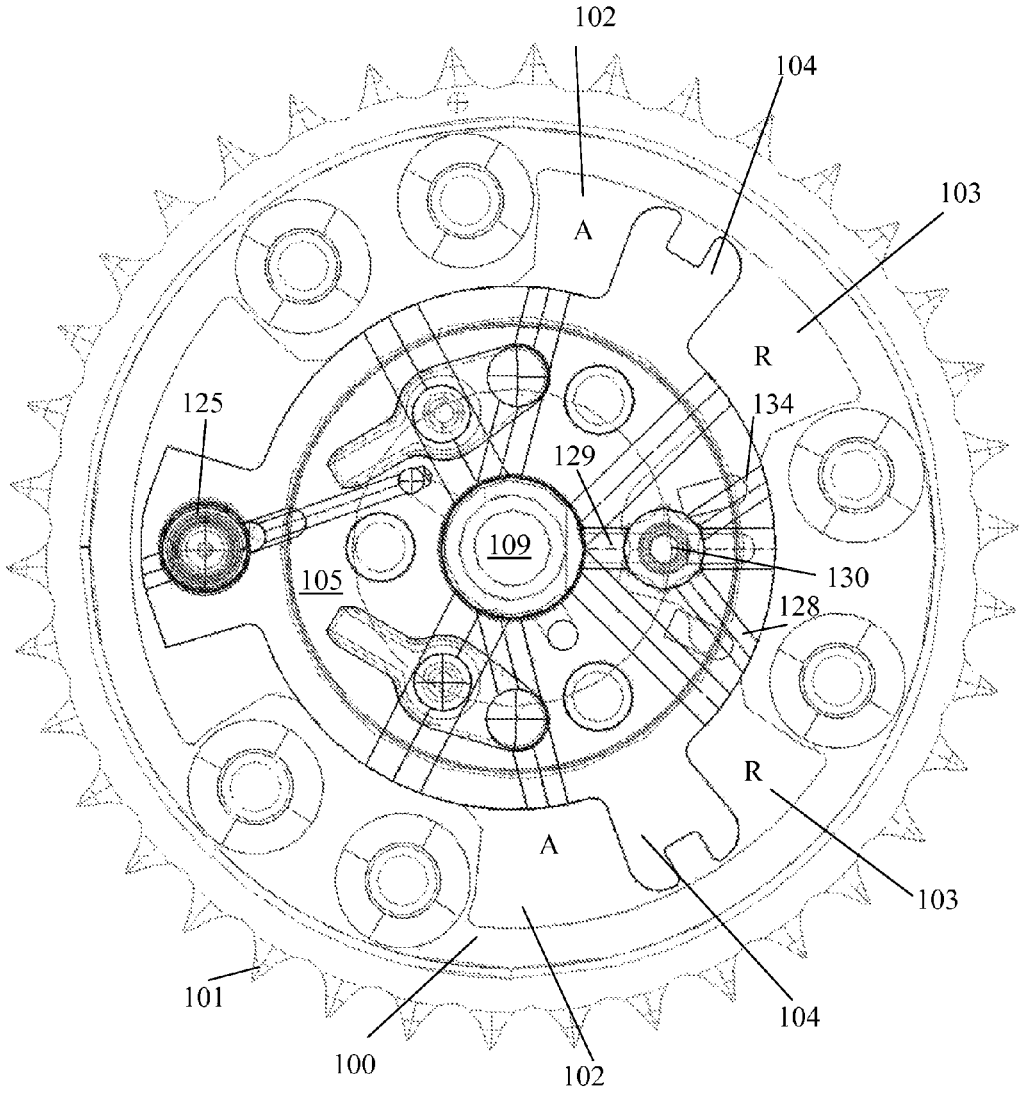
FIG. 10 shows a sectional view of the piloted valve when the phaser is in any of the advanced position, the retard position, or in the holding position with the lock pin in a released position.

Makeup oil is supplied to the phaser from supply S by pump 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 through either of the check valves 108,110, depending on which is open to the chambers 102, 103. Line 119*a* leads to the lock pin 125 and branches into line 132 which leads to the piloted valve 130. The pressure of the fluid in line 119*a* moves through the spool 111 between lands 111*b* and 111*c* to bias the lock pin 125 against the spring 124 to a released position, filling the lock pin circuit 123 with fluid. The fluid in line 119*a* also flows through line 132 and pressurizes the piloted valve 130 against the spring 131, moving the piloted valve 130 to a position where retard decent line 134, advance detent line 128 and line 129 are blocked as shown in FIGS. 1 and 10 and the detent circuit is off Exhaust line 122 is blocked by spool land 111*b*, preventing the lock pin 125 from venting.

Figure 2:
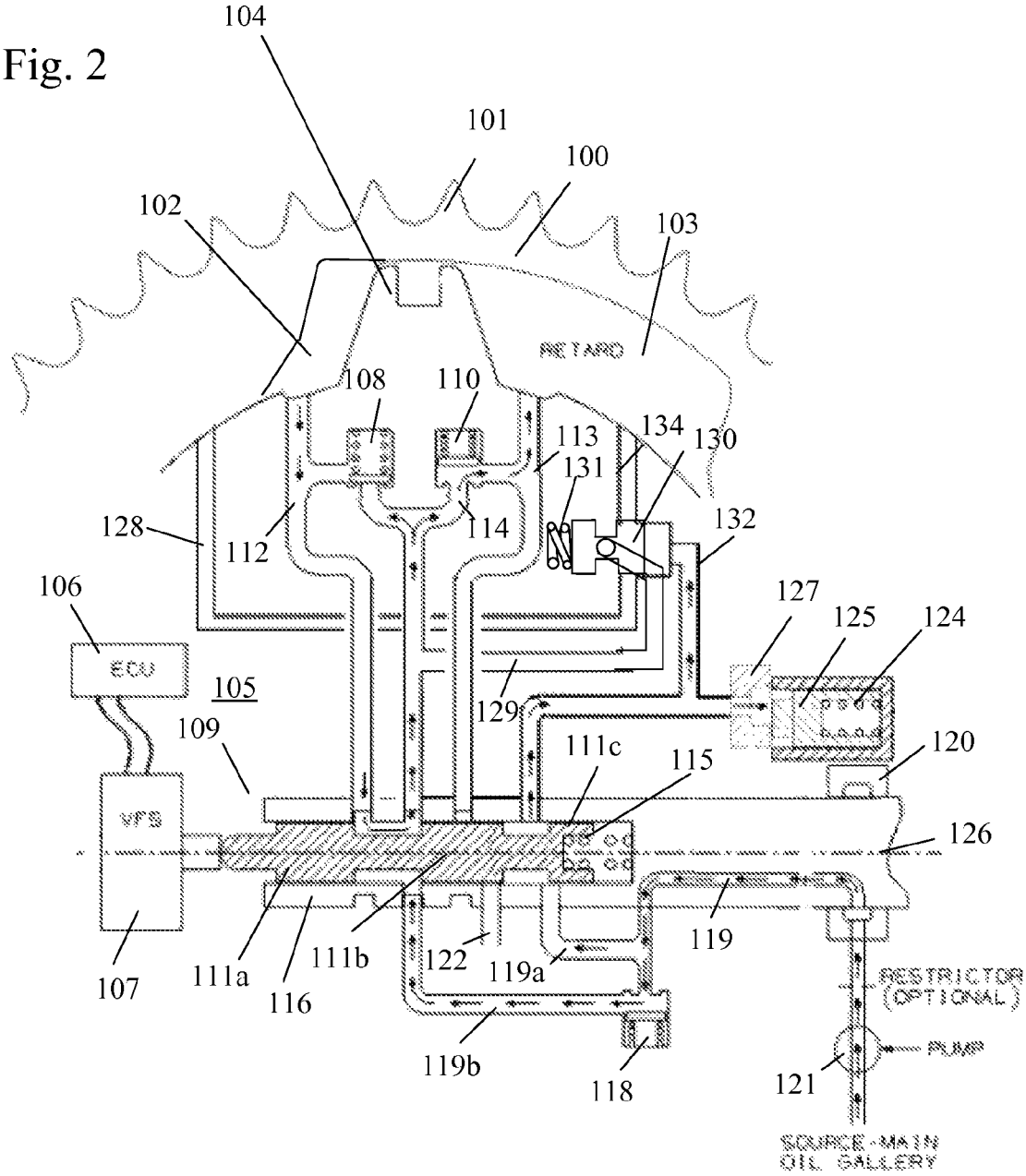
FIG. 2 shows a schematic of a first embodiment of the present invention moving towards a retard position.

FIG. 2 shows the phaser moving towards the retard position. To move towards the retard position, the duty cycle is adjusted to a range greater than 30% but less than 50%, the force of the VFS 107 on the spool 111 is changed and the spool 111 is moved to the left in a retard mode in the figure by spring 115, until the force of spring 115 balances the force of the VFS 107. In the retard mode shown, spool land 11 lb blocks line 113 and lines 112 and 114 are open. Camshaft torque pressurizes the advance chamber 102, causing fluid in the advance chamber 102 to move into the retard chamber 103, and the vane 104 to move in the direction shown by the arrow. Fluid exits from the advance chamber 102 through line 112 to the control valve 109 between spool lands 111*a* and 111*b* and recirculates back to central line 114 and line 113 leading to the retard chamber 103.

Makeup oil is supplied to the phaser from supply S by pump 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 through either of the check valves 108, 110, depending on which is open to the chambers 102, 103. Line 119*a* leads to the lock pin 125 and branches into line 132 which leads to the piloted valve 130. The pressure of the fluid in line 119*a* moves through the spool 111 between lands 111*b* and 111*c* to bias the lock pin 125 against the spring 124 to a released position, filling the lock pin circuit 123 with fluid. The fluid in line 119*a* also flows through line 132 and pressurizes the piloted valve 130 against the spring 131, moving the piloted valve 130 to a position where retard detent line 134 and the advance detent line 128 are blocked from line 129 and from each other as shown in FIGS. 2 and 10 and the detent circuit is off. Exhaust line 122 is blocked by spool land 111*b*, preventing the lock pin 125 and the piloted valve 130 from venting.

Figure 3:
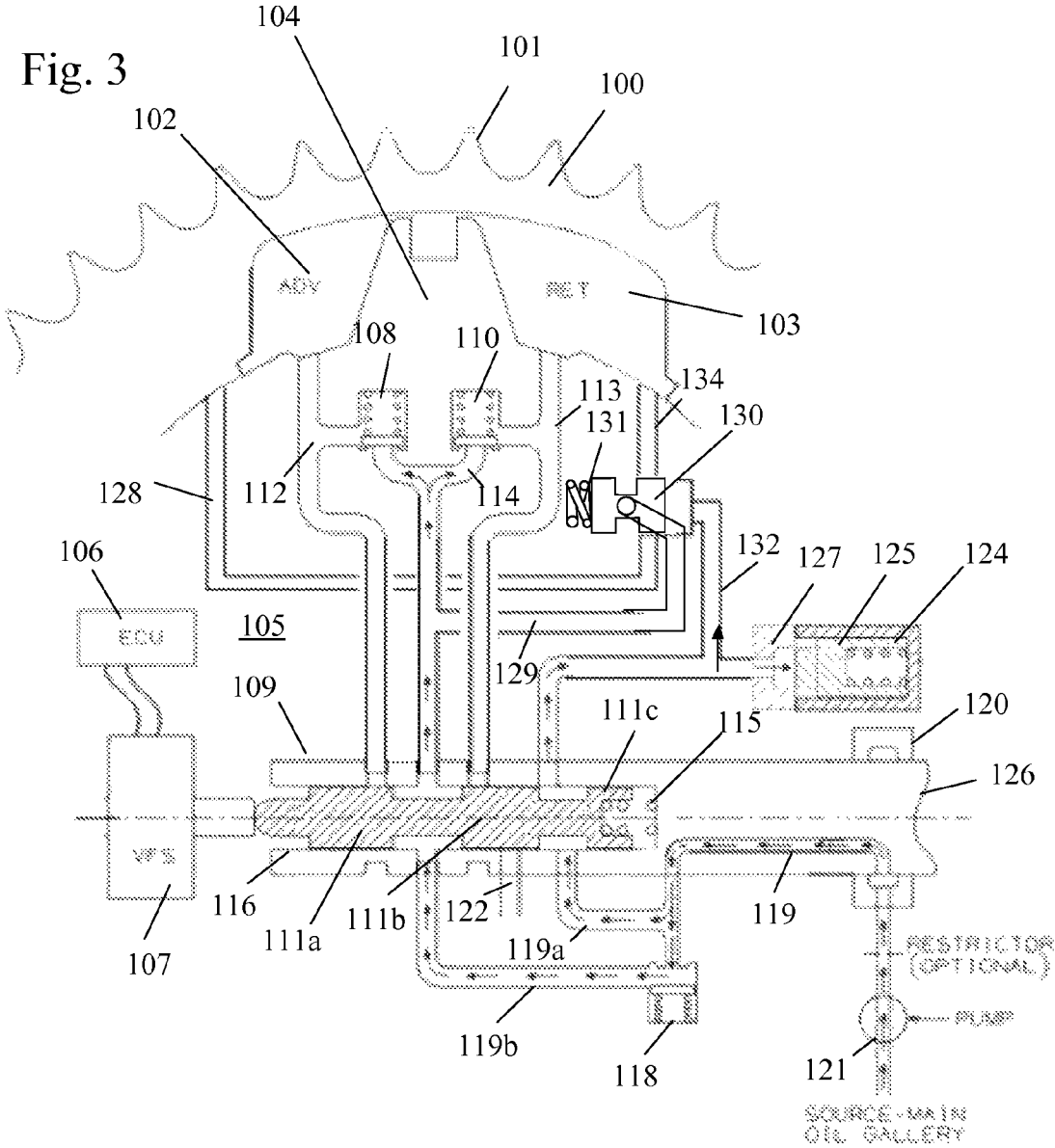
FIG. 3 shows a schematic of a first embodiment of the present invention in a holding position.
Figure 4A:
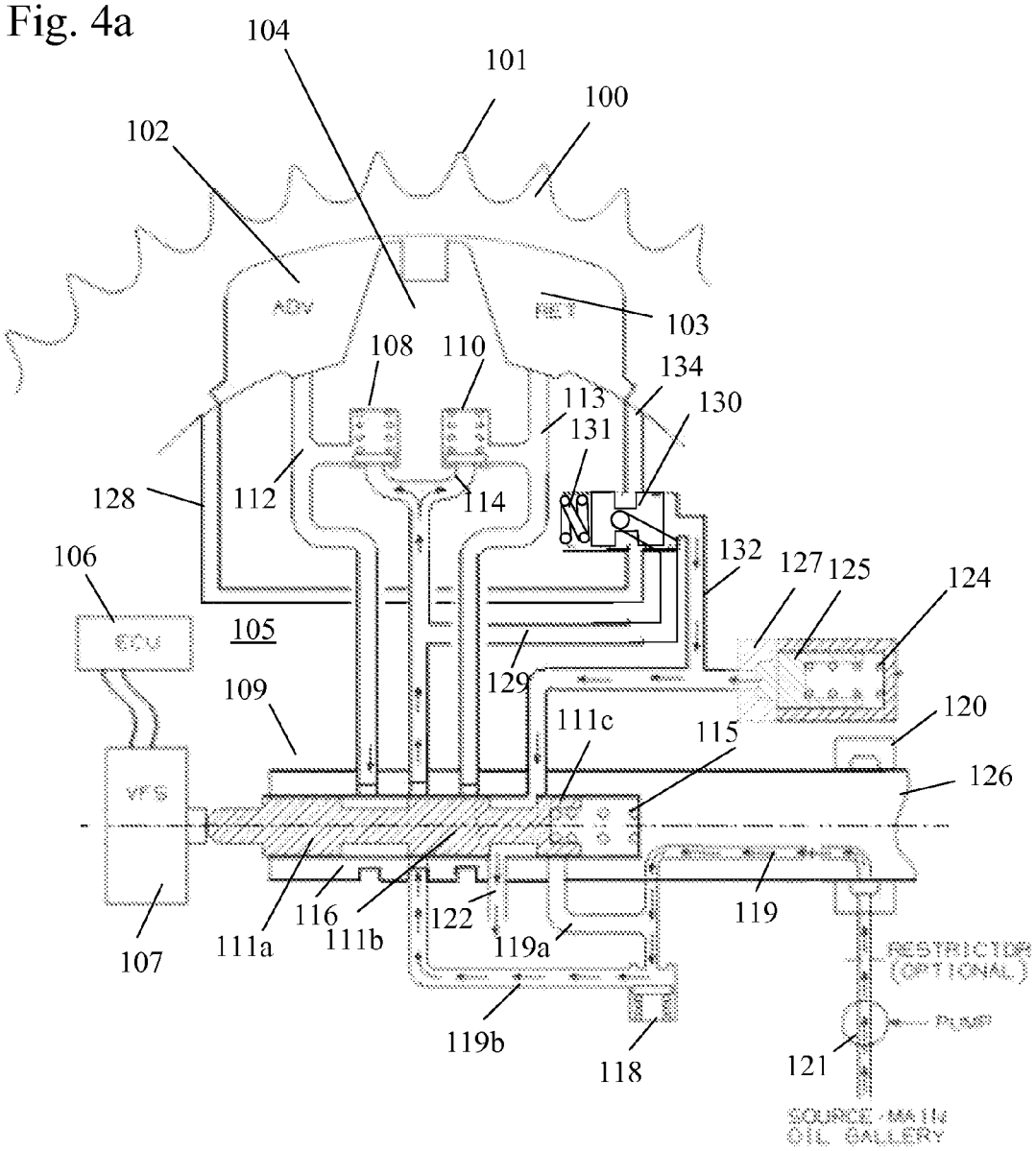
FIG. 4*a* shows a schematic of the first embodiment of the present invention in the detent position.
Figure 4B:
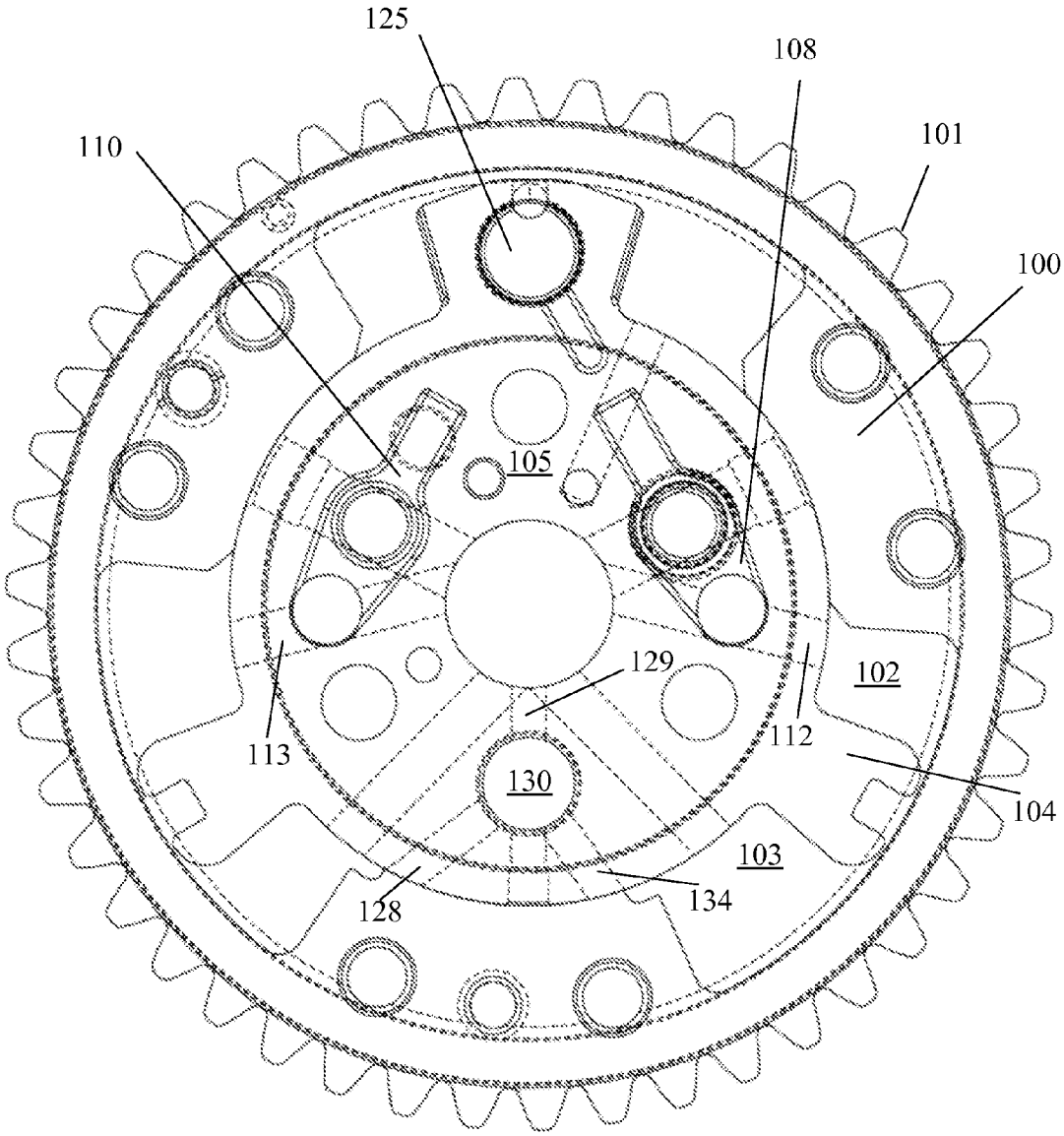
FIG. 4*b* shows the phaser of the first embodiment of the present invention in detent position.
Figure 5:
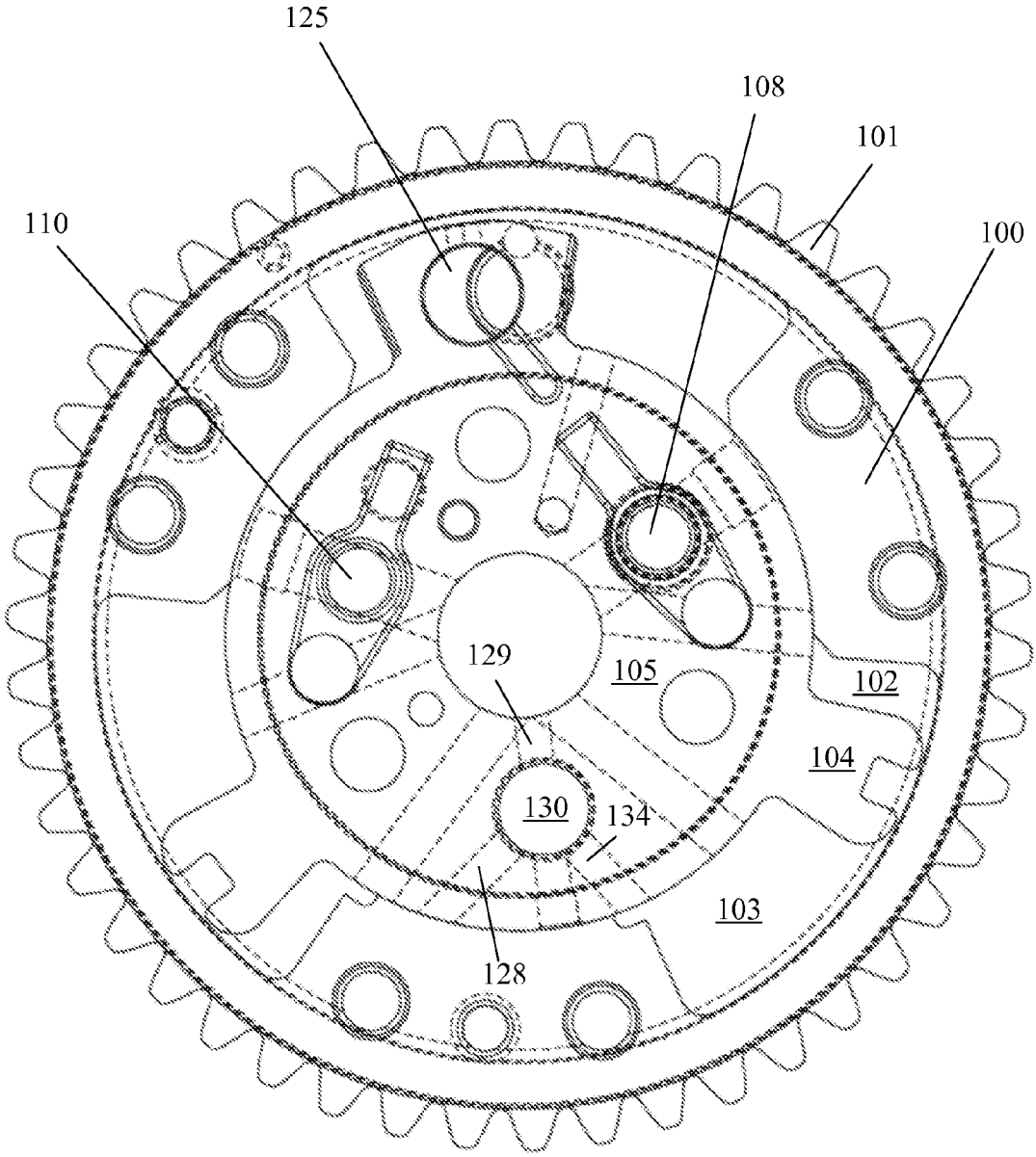
Figure 6:
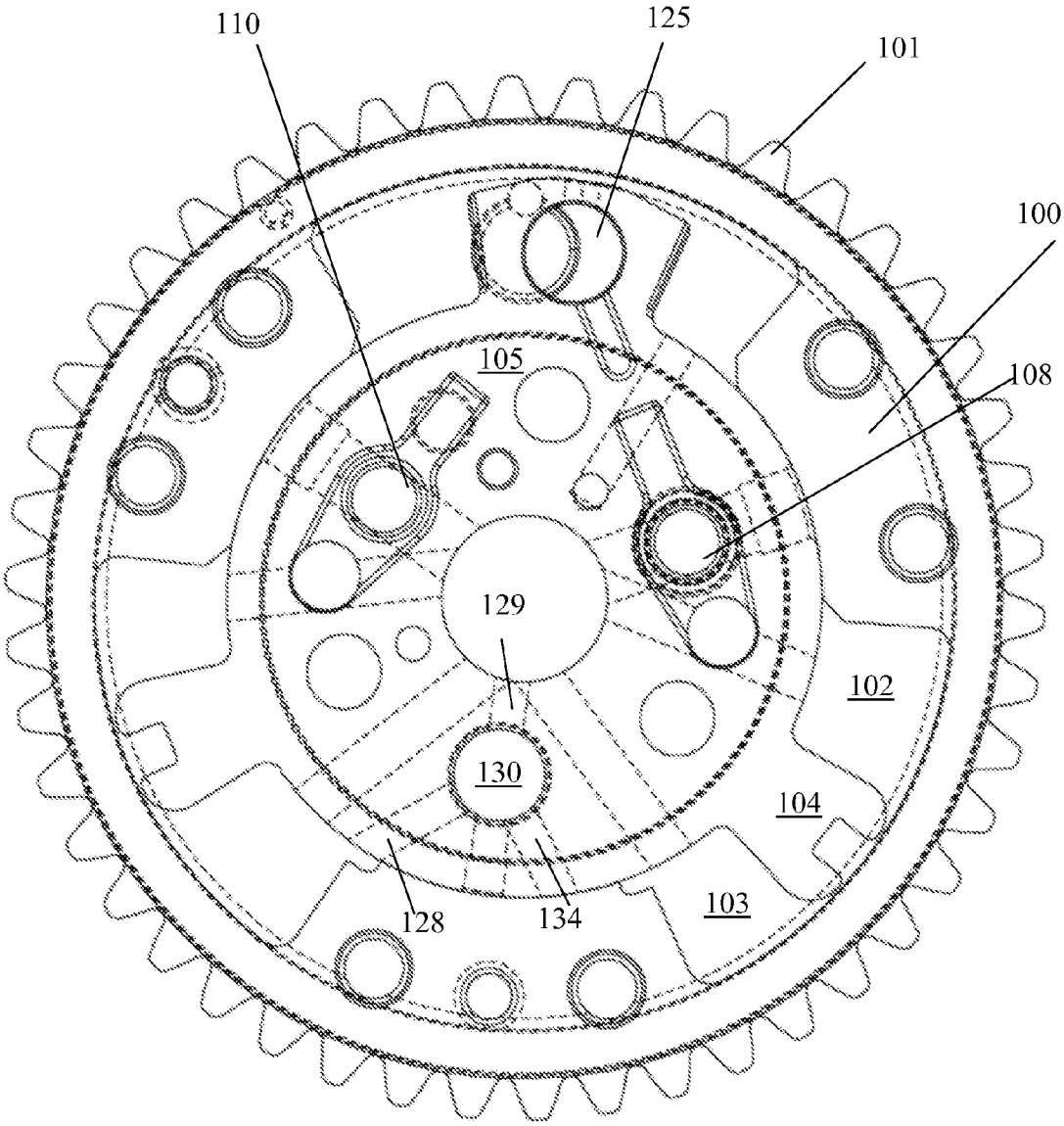
Figure 7A:
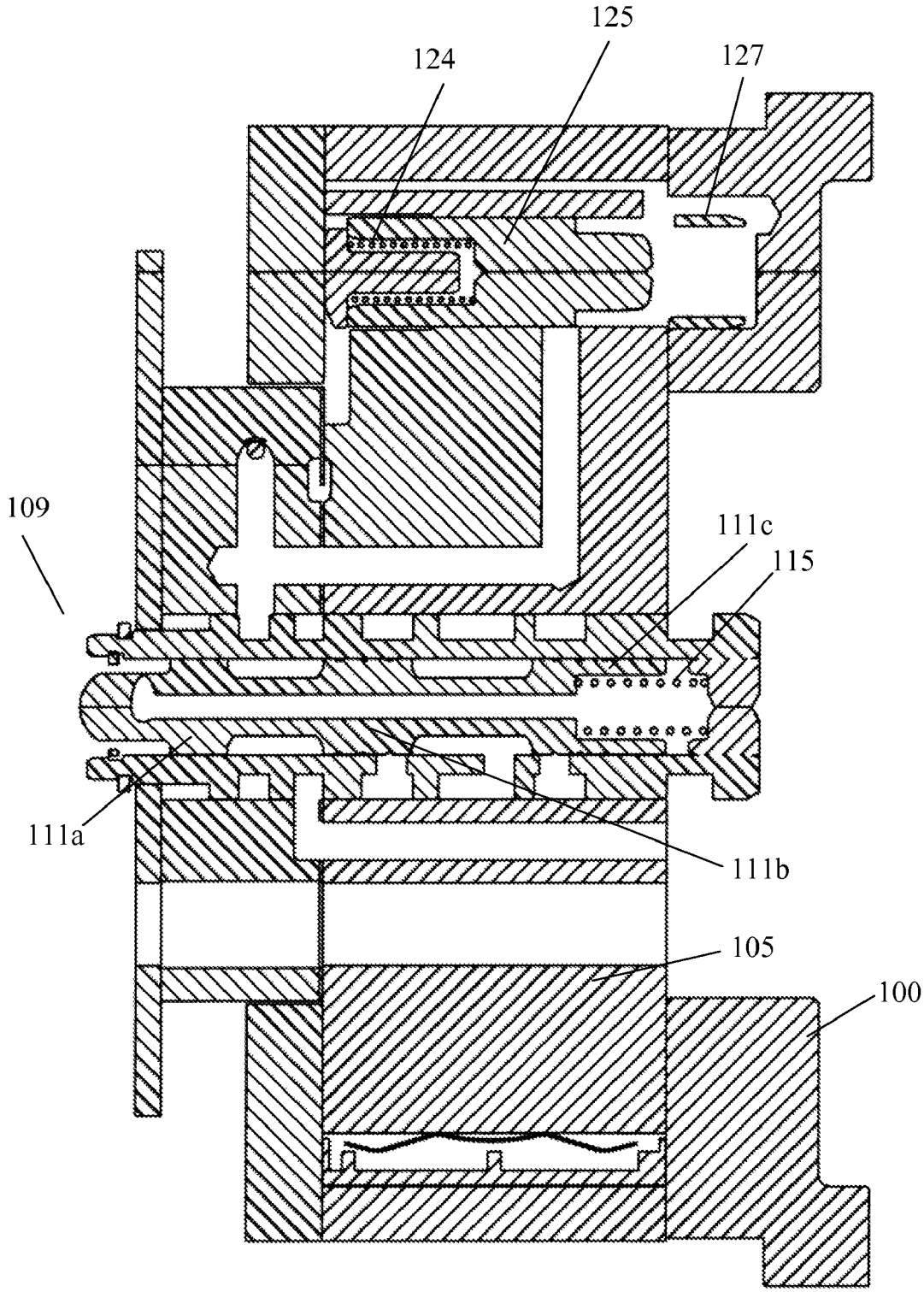
FIG. 7*a* shows a cross-section of the phaser of the first embodiment with the lock pin unlocked.
Figure 7B:
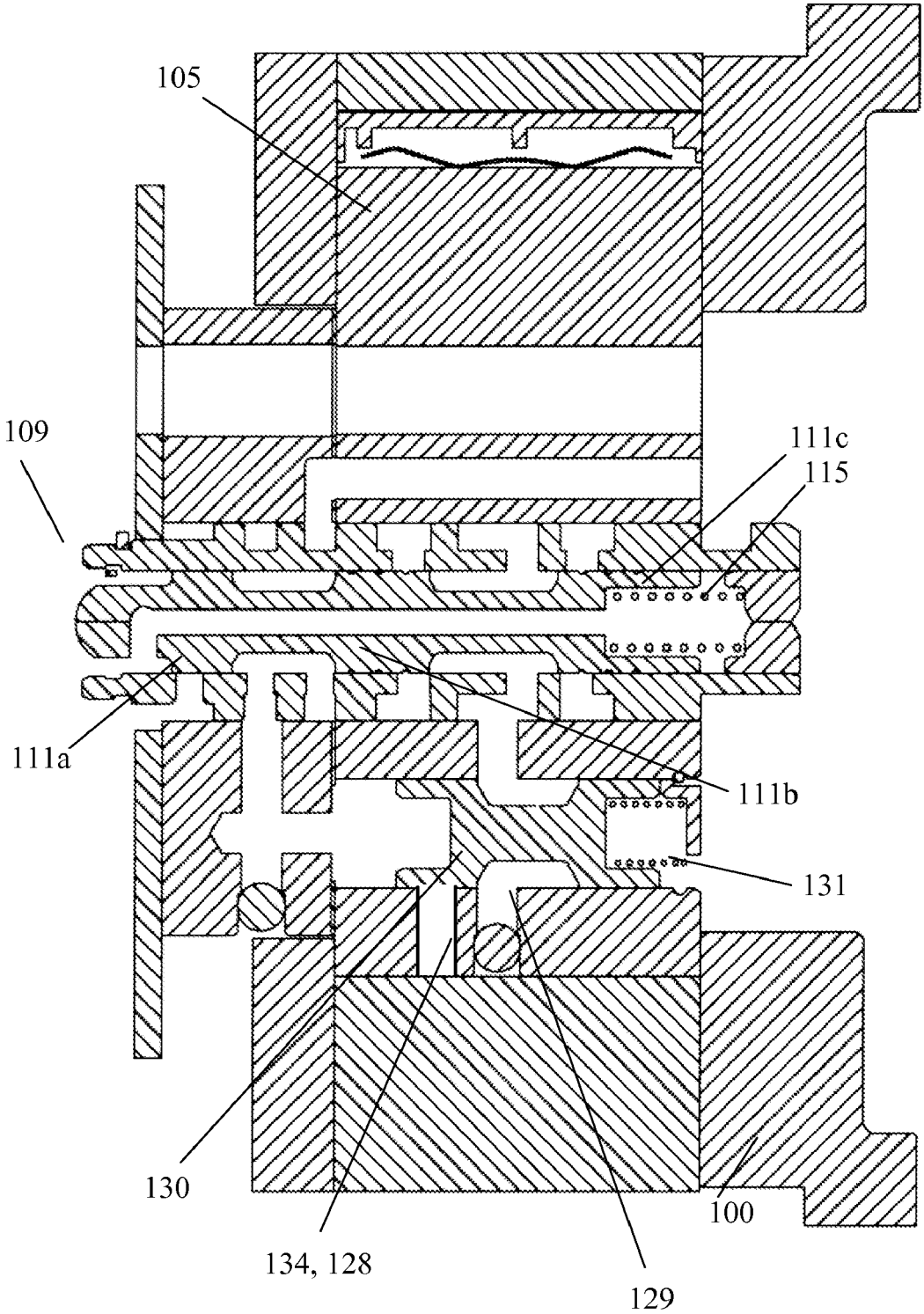
FIG. 7*b* shows a cross-section of the phaser of the first embodiment with the piloted valve in a position such that the hydraulic decent circuit is off.
Figure 8A:
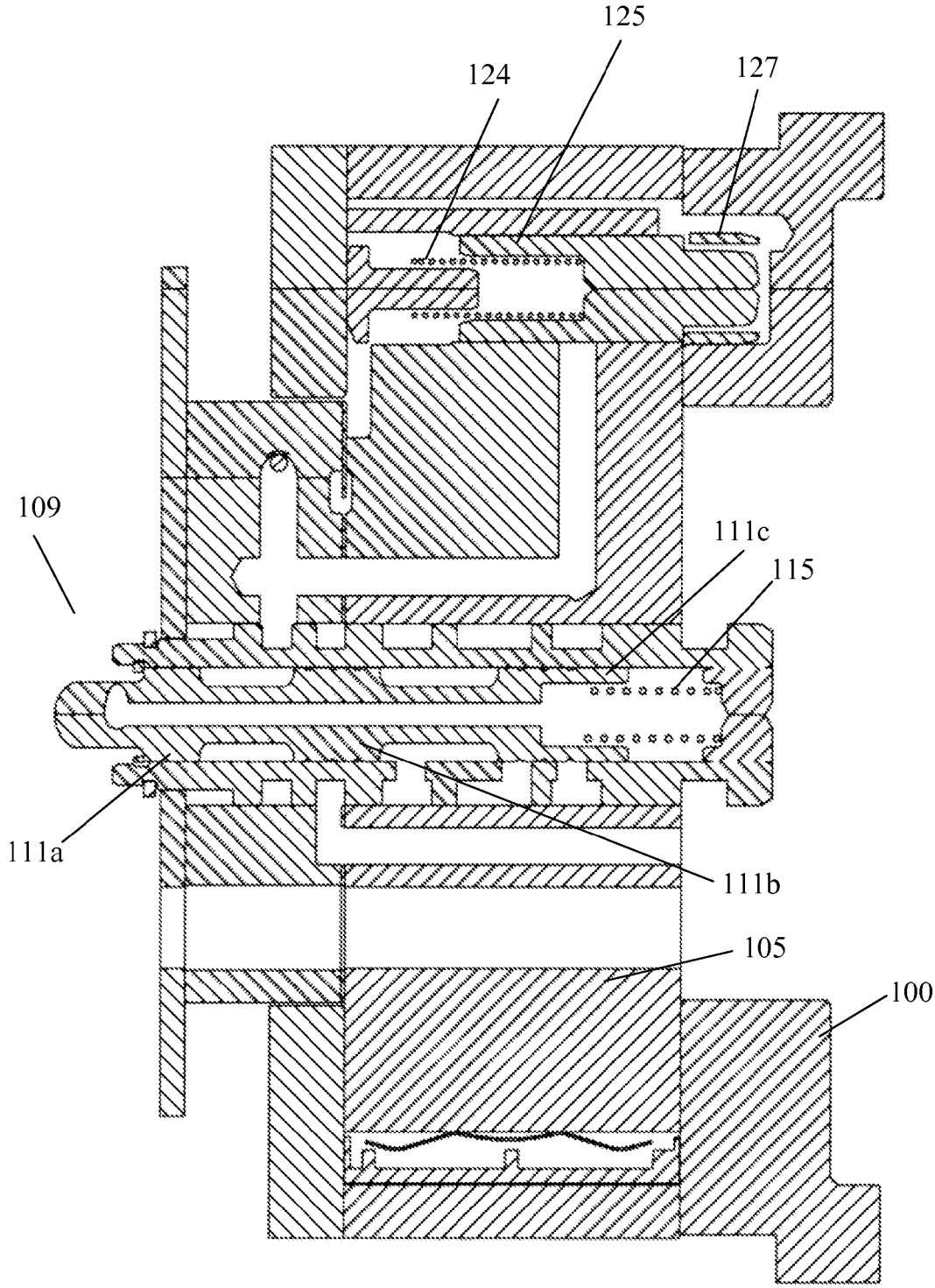
FIG. 8*a* shows a cross-section of the phaser of the first embodiment with the lock pin locked.
Figure 8B:
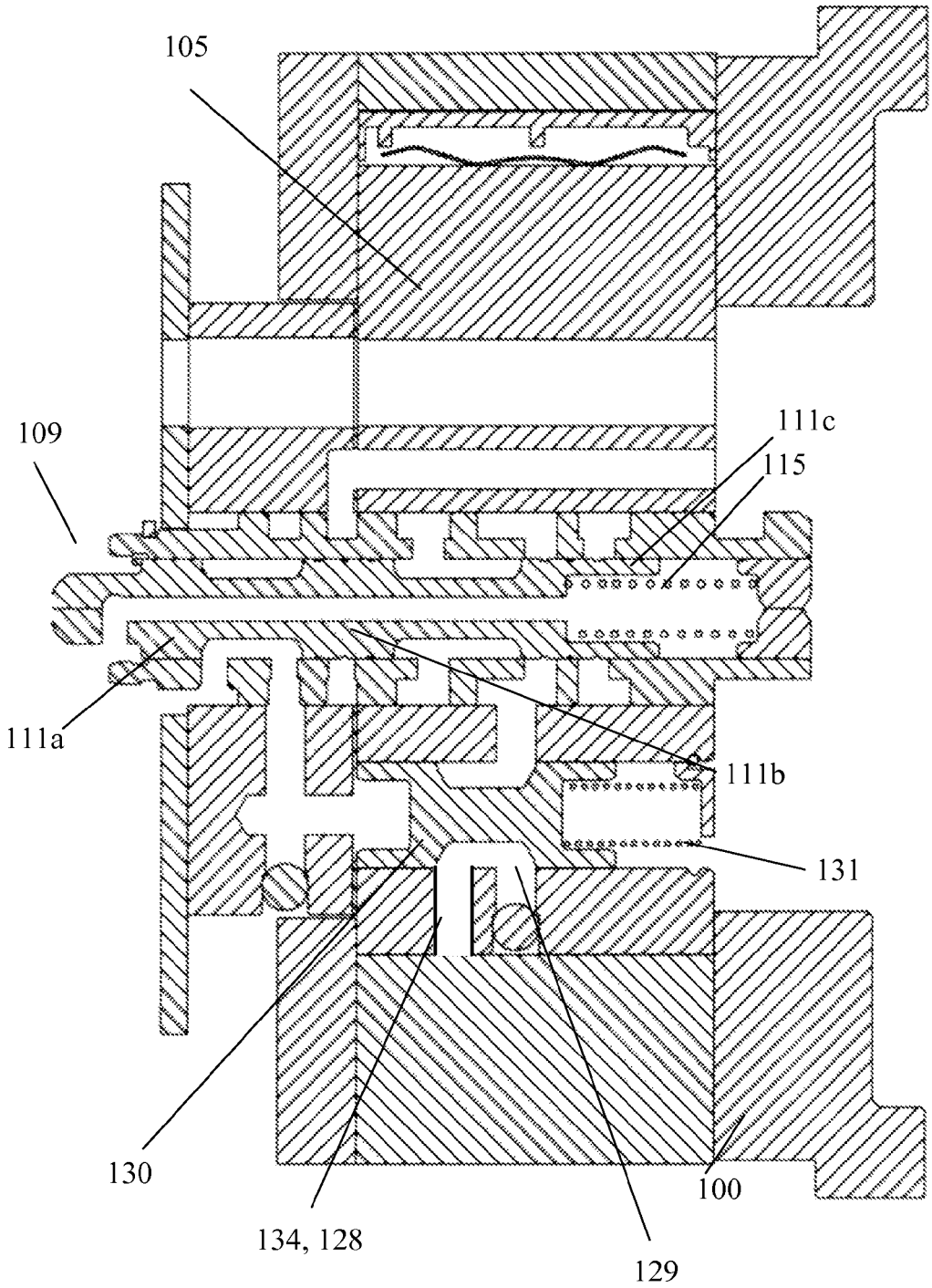
FIG. 8*b* shows a cross-section of the phaser of the first embodiment with the piloted valve in a position such that the hydraulic detent circuit is on or open.
Figure 9:
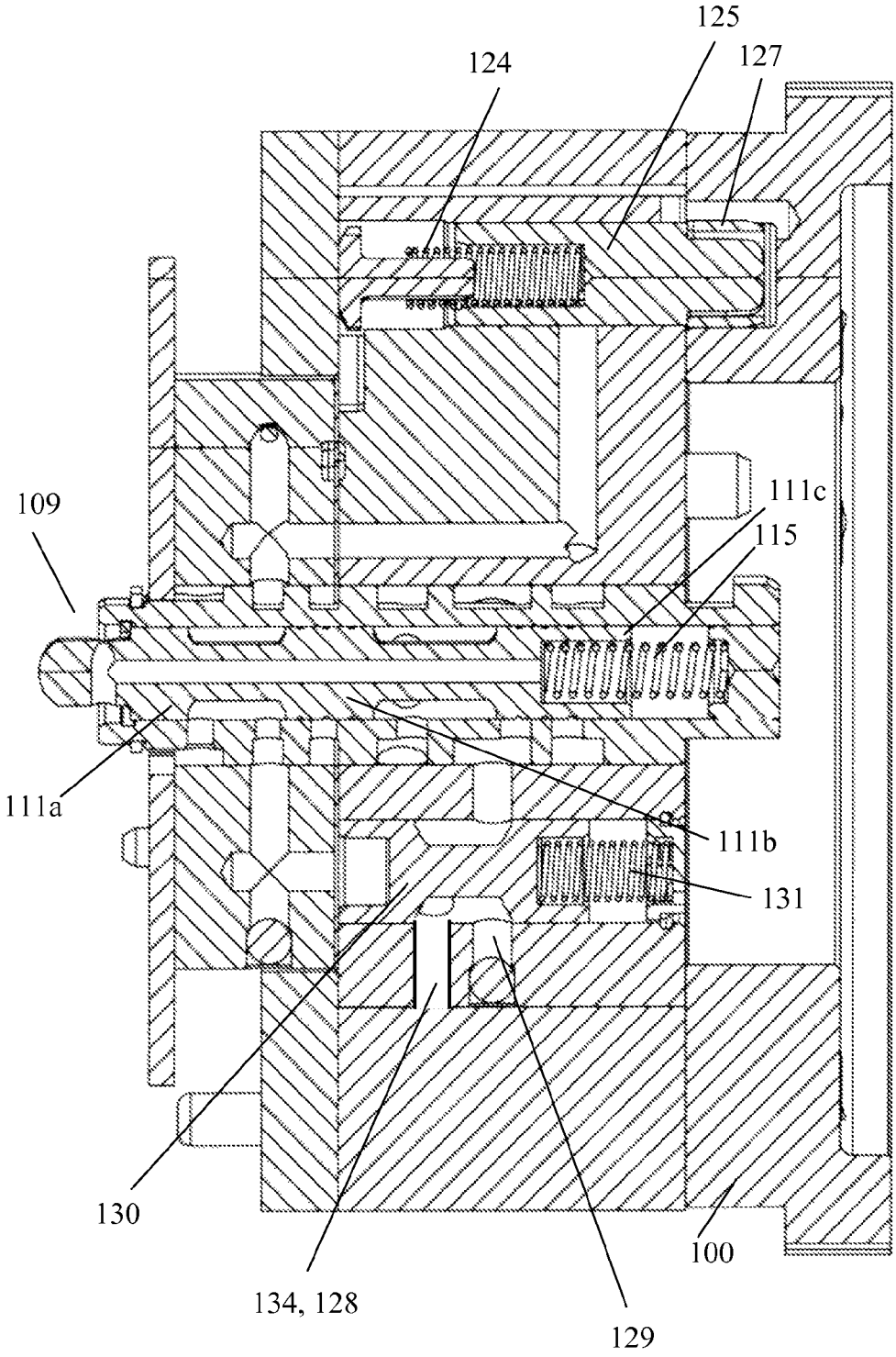
FIG. 9 shows an alternate cross-section of the phaser of the first embodiment with the lock pin locked and the pilot valve in a position such that the hydraulic detent circuit is on or open.

FIG. 3 shows the phaser in the holding position. In this position, the duty cycle of the variable force solenoid 107 is 50% and the force of the VFS 107 on one end of the spool 111 equals the force of the spring 115 on the opposite end of the spool 111 in holding mode. The lands 111*a* and 111*b* block the flow of fluid to lines 112 and 113 respectively. Makeup oil is supplied to the phaser from supply S by pump 121 to make up for leakage and enters line 119 through a bearing 120. Line 119 splits into two lines 119*a* and 119*b*. Line 119*b* leads to inlet check valve 118 and the control valve 109. From the control valve 109, fluid enters line 114 through either of the check valves 108, 110, depending on which is open to the chambers 102, 103. Line 119*a* leads to the lock pin 125 and branches into line 132 which leads to the piloted valve 130. The pressure of the fluid in line 119*a* moves through the spool 111 between lands 111*b* and 111*c* to bias the lock pin 125 against the spring 124 to a released position, filling the lock pin circuit 123. The fluid in line 119*a* also flows through line 132 and pressurizes the piloted valve 130 against the spring 131, moving the piloted valve 130 to a position where retard detent line 134 and advance detent line 128 are blocked from line 129 and from each other as shown in FIGS. 3 and 10 and the detent circuit 133 is off. Exhaust line 122 is blocked by spool land 111*b*, preventing the lock pin 125 and piloted valve 130 from venting.

FIGS. 5, 6, 7*a*, 7*b*, 10 show the phaser moving towards the intermediate phase angle position. FIGS. 4*a*, 4*b*, 8*a*, 8*b*, 9 show the phaser in the mid position or intermediate phase angle position. When the duty cycle of the variable force solenoid 107 is 0%, the spool is in detent mode, the piloted valve 130 is vented, the hydraulic detent circuit 133 is open or on, and the lock pin circuit 123 is off or closed, the lock pin 125 is vented and engages with a recess 127, and the rotor 105 is locked relative to the housing assembly 100 in a mid position or an intermediate phase angle position. Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the detent circuit 133 to a mid lock position or an intermediate phase angle position and the lock pin 125 would be engaged in mid position or intermediate phase angle position regardless of what position the vane 104 was in relative to the housing assembly 100 prior to the abnormal shut down of the engine. The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the VFS on the spool 111 is decreased, and the spring 115 moves the spool 111 to the far left end of the spools travel to a detent position as shown in the Figures. In this detent position, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 to line 119*b* and inlet check valve 118 to the common line 114. Fluid is prevented from flowing through line 119*a* to the lock pin 125 by spool land 111*c*. Since fluid cannot flow to line 119*a*, the lock pin 125 is no longer pressurized and vents through the spool 111 to exhaust line 122. Similarly, the piloted valve 130 also vents to line 122, opening passage between the advance detent line 128 and the retard detent line 134 through the piloted valve 130 to line 129 and the common line 114, in other words opening the hydraulic detent circuit 133.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to an intermediate phase angle position or a mid position within the chamber formed between the housing assembly 100 and the rotor assembly 105, and the lock pin 125 aligns with recess 127, locking the rotor assembly 105 relative to the housing assembly 100 in a mid position or an intermediate phase angle position.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor 105 closes off line the retard detent 134 from the retard chamber 103, the vane 104 is moved to an intermediate phase angle position or a mid position within the chamber formed between the housing assembly 100 and the rotor assembly 105, and the lock pin 125 aligns with the recess 127, locking the rotor 105 relative to the housing assembly 100 in a mid position or an intermediate phase angle position.

The advance detent line 128 and the retard detent line 134 are completely closed off or blocked by the rotor assembly 105 from the advance and retard chambers 102, 103 when phaser is in the mid position or intermediate phase angle position, requiring that the lock pin 125 engages the recess 127 at the precise time in which the advance detent line 128 or the retard detent line 134 are closed off from their respective chambers. Alternatively, the advance detent line 128 and the retard detent line 134 may be slightly open or partially restricted to the advance and retard chambers 102, 103, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 11:
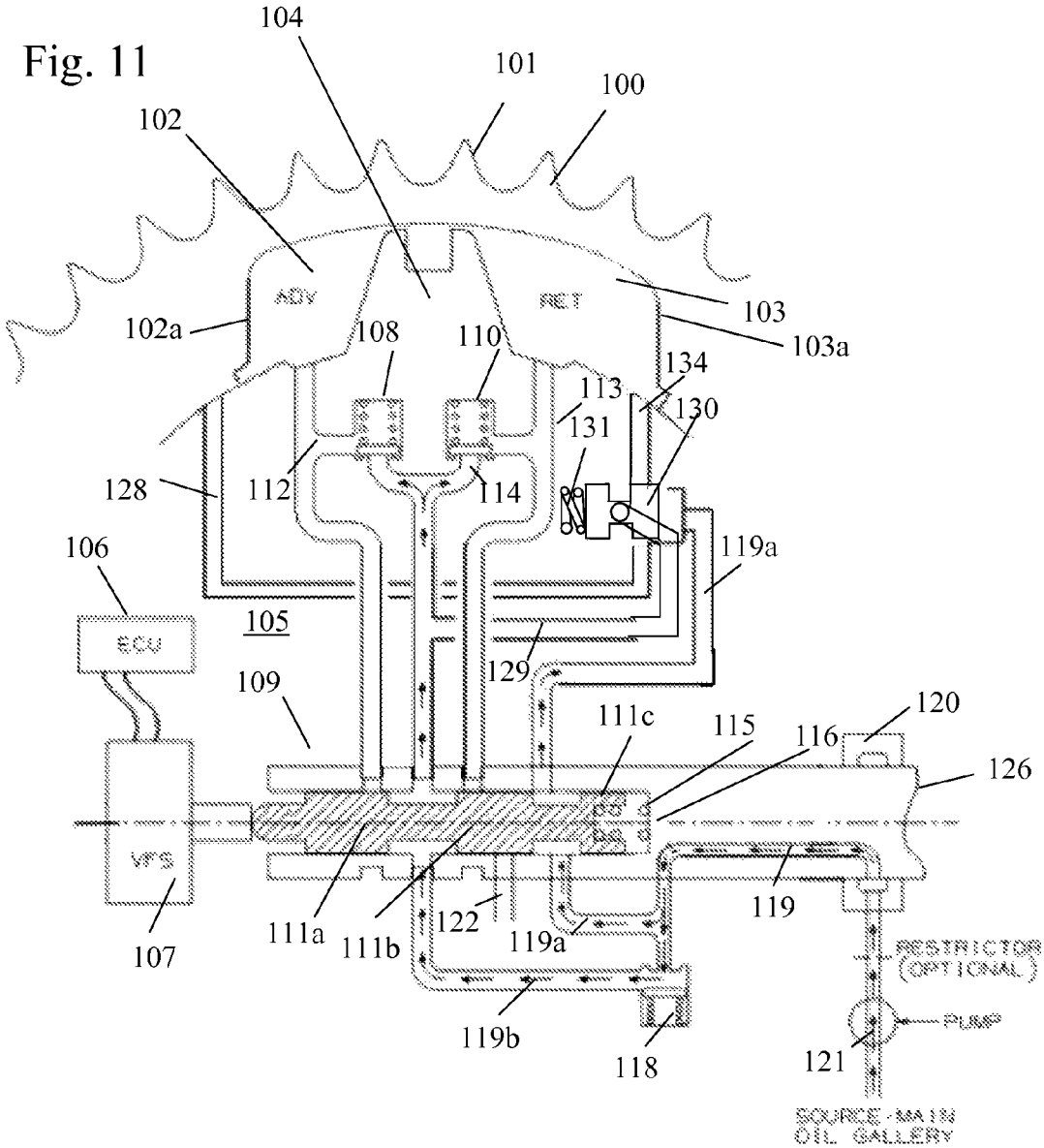
FIG. 11 shows a schematic of a second embodiment of the present invention, with the piloted valve in a first position, the phaser in the holding position, and the piloted valve controlled by supply through the control valve.
Figure 12:
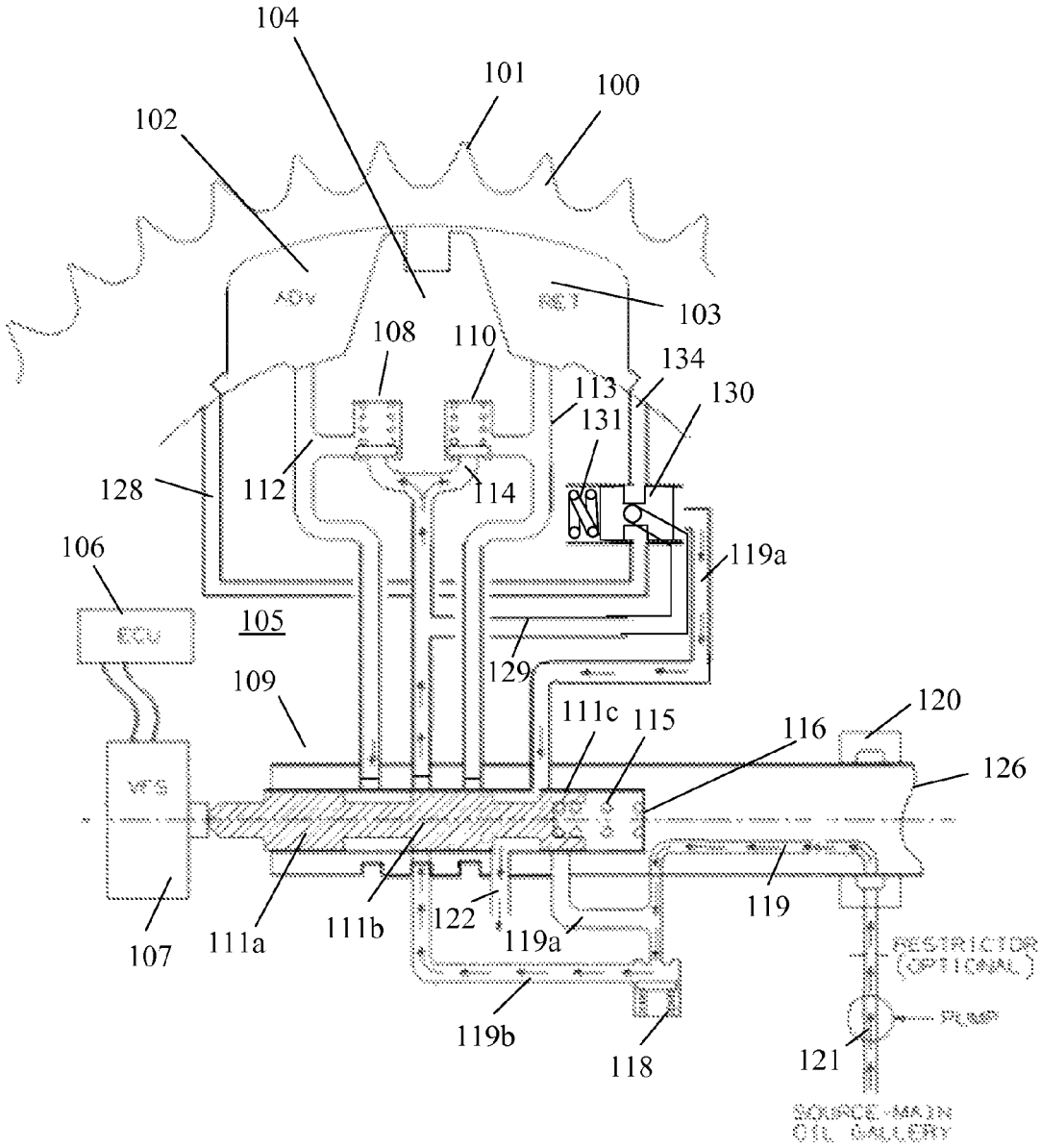
FIG. 12 shows a schematic of a second embodiment of the present invention, with the piloted valve in a second position, the phaser in the intermediate phase angle position and the piloted valve controlled by supply through the control valve.

FIGS. 11-12 show a second embodiment of the present invention in which the piloted valve 130 and the hydraulic detent circuit 133 are controlled and supplied with fluid through the control valve 109 of the phaser. Movement of the piloted valve is actively controlled by the control valve 109 of the phaser. FIG. 11 shows the phaser in the holding position and the control valve 109 in null mode. FIG. 12 shows the control valve 109 in the detent mode and the hydraulic detent circuit 133 on. The advance mode and the retard mode are not shown, but are similar to FIGS. 1 and 2 of the first embodiment, where the hydraulic detent circuit 133 is off. The hydraulic detent circuit 133 includes a spring 131 loaded piloted valve 130 and an advance detent line 128 that connects the advance chamber 102 to the piloted valve 130 and the common line 114, and a retard detent line 134 that connects the retard chamber 103 to the piloted valve 130 and the common line 114.

Referring to FIG. 11, the duty cycle of the variable force solenoid 107 is 50% and the force of the VFS 107 on one end of the spool 111 equals the force of the spring 115 on the opposite end of the spool 111 in null mode. The lands 111*a* and 111*b* block the flow of fluid to lines 112 and 113 respectively. Makeup oil is supplied to the phaser from supply S by pump 121 to make up for leakage and enters line 119 through a bearing 120. Line 119 splits into two lines 119*a* and 119*b*. Line 111*b* leads to inlet check valve 118 and the control valve 109. From the control valve 109, fluid enters line 114 through either of the check valves 108, 110, depending on which is open to the chambers 102, 103. Line 119*a* leads to the piloted valve 130. The pressure of the fluid in line 119*a* moves through the spool 111 between lands 111*b* and 111*c* to pressurizes the piloted valve 130 against the spring 131, moving the piloted valve 130 to a position where retard detent line 134, advance detent line 128 are blocked as shown in FIG. 11 and the detent circuit is off. Exhaust line 122 is blocked by spool land 111*b*, preventing the detent circuit 133 from venting or opening.

FIG. 12 shows the phaser in the mid position or intermediate phase angle position, where the duty cycle of the variable force solenoid is 0%, the spool 109 is in detent mode, the piloted valve 130 is vented through the spool to passage 122 leading to sump or exhaust, and the hydraulic detent circuit 133 is open or on.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0% the rotor assembly 105 would move via the detent circuit to the mid position or intermediate phase angle position and the lock pin 125 would be engaged in mid position or intermediate phase angle position regardless of what position the vane 104 was in relative to the housing assembly 100 prior to the abnormal shut down of the engine. The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the NTS on the spool 111 is decreased, and the spring 115 moves the spool 111 to the far left end of the spool's travel to a detent mode as shown in the FIG. 12. In the detent mode, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 to line 119*b* and inlet check valve 118 to the common line 114. Fluid is prevented from flowing through line 119*a* to the piloted valve 130 by spool land 111*c*. Since fluid cannot flow to line 119*a*, the piloted valve 130 vents to exhaust line 122, opening passage between the advance detent line 128 and the retard detent line 134 through the piloted valve 130 to line 129 and the common line 114, in other words, opening or turning on the hydraulic detent circuit 133.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to a mid position or intermediate phase angle position within the chamber formed between the housing assembly 100 and the rotor assembly 105.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes off line the retard detent 134 from the retard chamber 103, the vane 104 is moved to a mid position or intermediate phase angle position within the chamber formed between the housing assembly 100 and the rotor assembly 105.

Figure 13:
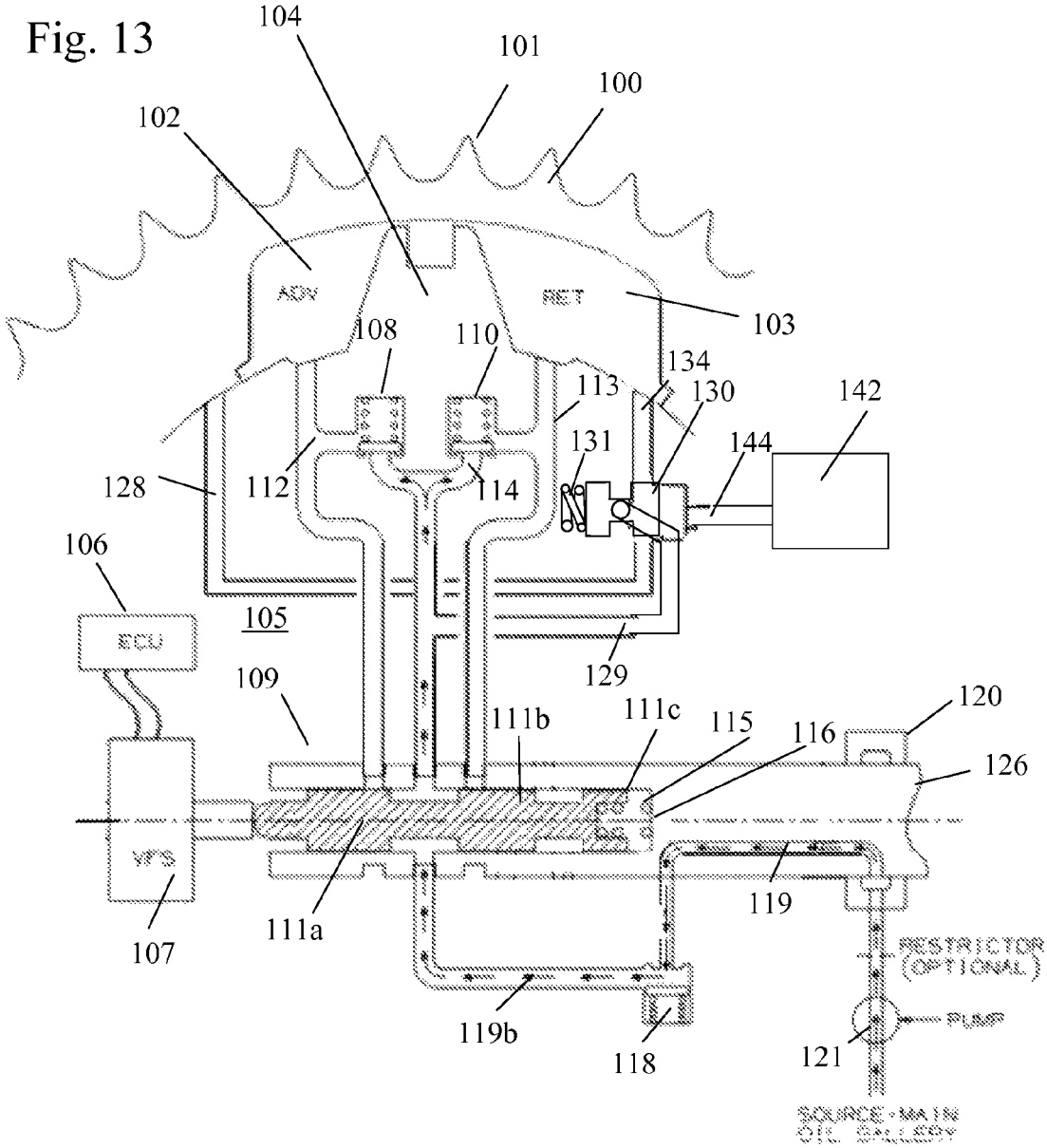
FIG. 13 shows a schematic of a third embodiment of the present invention, with the piloted valve in a first position, the phaser in the holding position, and the piloted valve is controlled by other hydraulic means.
Figure 14:
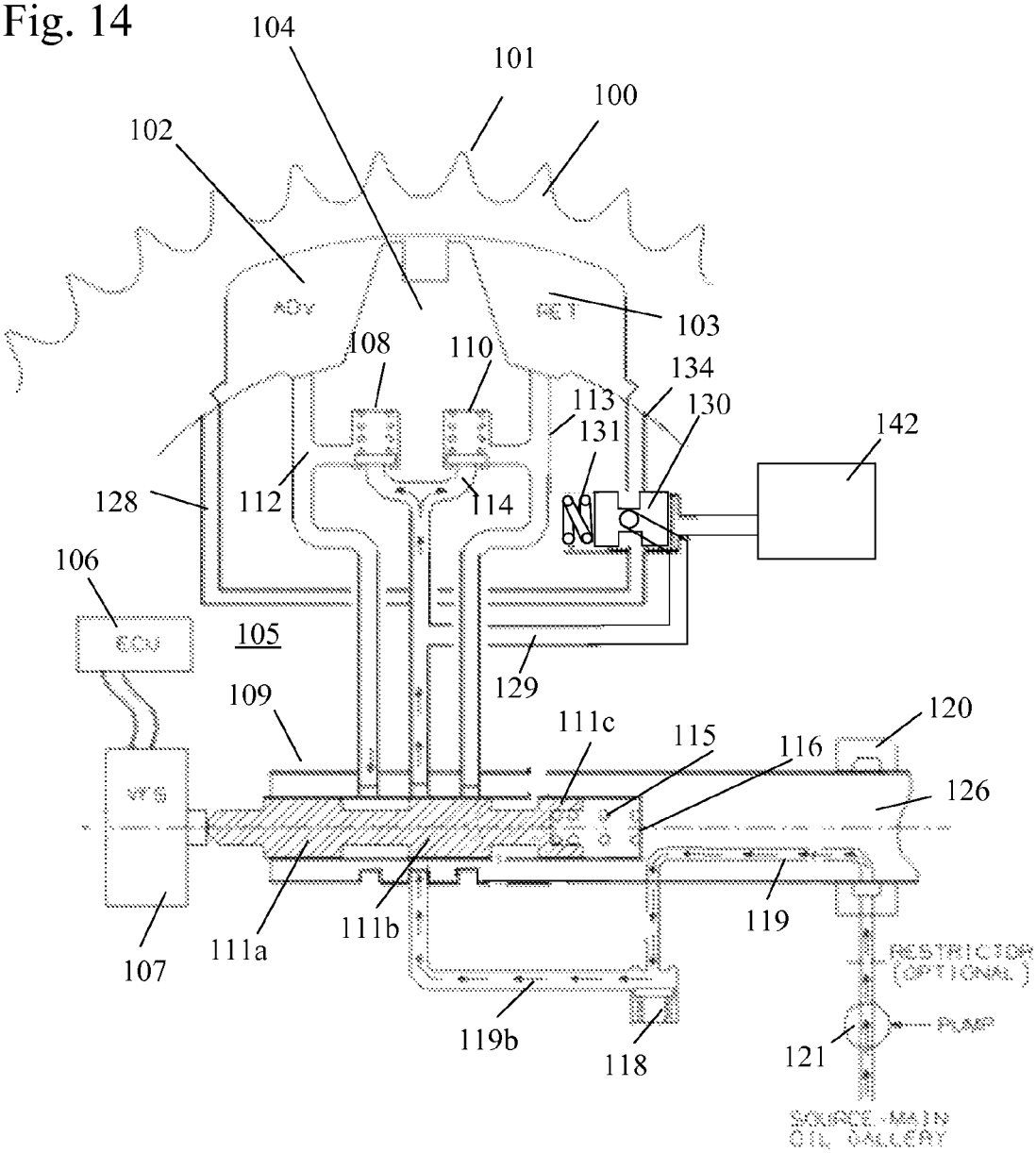
FIG. 14 shows a schematic of a third embodiment of the present invention, with the piloted valve in a second position, the phaser in the intermediate phase angle position, and the piloted valve is controlled by other hydraulic means.

FIGS. 13-14 show a third embodiment of the present invention in which the piloted valve 130 and the hydraulic detent circuit 133*a* are controlled and supplied with fluid by remote means 142. The remote means 142 may be any on/off hydraulic valve, for example a solenoid valve. Movement of the piloted valve is actively controlled by the remote on/off valve. FIG. 13 shows the phaser in the holding position and the control valve in holding mode. FIG. 14 shows the control valve in the detent mode and the hydraulic detent circuit on. The advance mode and the retard mode are not shown, but are similar to FIGS. 1 and 2 of the first embodiment, where the hydraulic detent circuit 133 is off. The hydraulic detent circuit 133*a* includes a spring 131 loaded piloted valve 130 and an advance detent line 128 that connects the advance chamber 102 to the piloted valve 130 and the common line 114, and a retard detent line 134 that connects the retard chamber 103 to the piloted valve 130, the common line 114 and line 144 connected to the remote means 142.

Referring to FIG. 13, the duty cycle of the variable force solenoid 107 is 50% and the force of the VFS 107 on one end of the spool 111 equals the force of the spring 115 on the opposite end of the spool 111 in null mode. The lands 111*a* and 111*b* block the flow of fluid to lines 112 and 113 respectively. Makeup oil is supplied to the phaser from supply S by pump 121 to make up for leakage and enters line 119 through a bearing 120. Line 119 leads to inlet check valve 118 and the control valve 109. From the control valve 109, fluid enters line 114 through either of the check valves 108, 110, depending on which is open to the chambers 102, 103. Fluid is supplied to the piloted valve 130 from hydraulic means 142, and pressurizes the piloted valve 130 against the spring 131, moving the piloted valve 130 to a position where retard detent line 134 and the advance detent line 128 are blocked from line 129 and from each other and the detent circuit 133 is off The piloted valve 130 and the detent circuit 133*a* are prevented from venting by the hydraulic means 142. In other words, the hydraulic means 142 is switched on and is providing fluid through line 144 to the piloted valve 130 only.

FIG. 14 shows the phaser in the mid position or intermediate phase angle position, where the duty cycle of the variable force solenoid is 0%, the spool 109 is in detent mode, the piloted valve 130 is vented through the hydraulic means 142 leading to exhaust, and the hydraulic detent circuit 133*a* is open.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0% and the rotor assembly 105 will move via the detent circuit to the mid position or intermediate phase angle position and the lock pin 125 would be engaged in mid position or intermediate phase angle position regardless of what position the vane 104 was in relative to the housing assembly 100 prior to the abnormal shut down of the engine. With the ability of the phaser of the present invention to default to a mid position or intermediate phase angle position without using electronic controls, allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the NTS on the spool 111 is decreased, and the spring 115 moves the spool 111 to the far left end of the spool's travel to a detent mode as shown in the FIG. 14. In the detent mode, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 through the inlet check valve 118 to the common line 114. Fluid is prevented from flowing from the hydraulic means 142 through line 144 to the piloted valve 130 by the hydraulic means 142. In other words, the hydraulic means 142 would be switched off, and allowing venting of the fluid in line PH only Therefore, the piloted valve 130 vents to the hydraulic means 142 through line 144, opening passage between the advance detent line 128 and the retard detent line 134 through the piloted valve 130 to line 129 and the common line 114, in other words opening the hydraulic detent circuit 133*a*.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes of the advance detent line 128 from the advance chamber 102, the vane 104 is moved to a mid position or intermediate phase angle position within the chamber formed between the housing assembly 100 and the rotor assembly 105.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes off line the retard detent 134 from the retard chamber 103, the vane 104 is moved to a mid position or intermediate phase angle position within the chamber formed between the housing assembly 100 and the rotor assembly 105.

Figure 15:
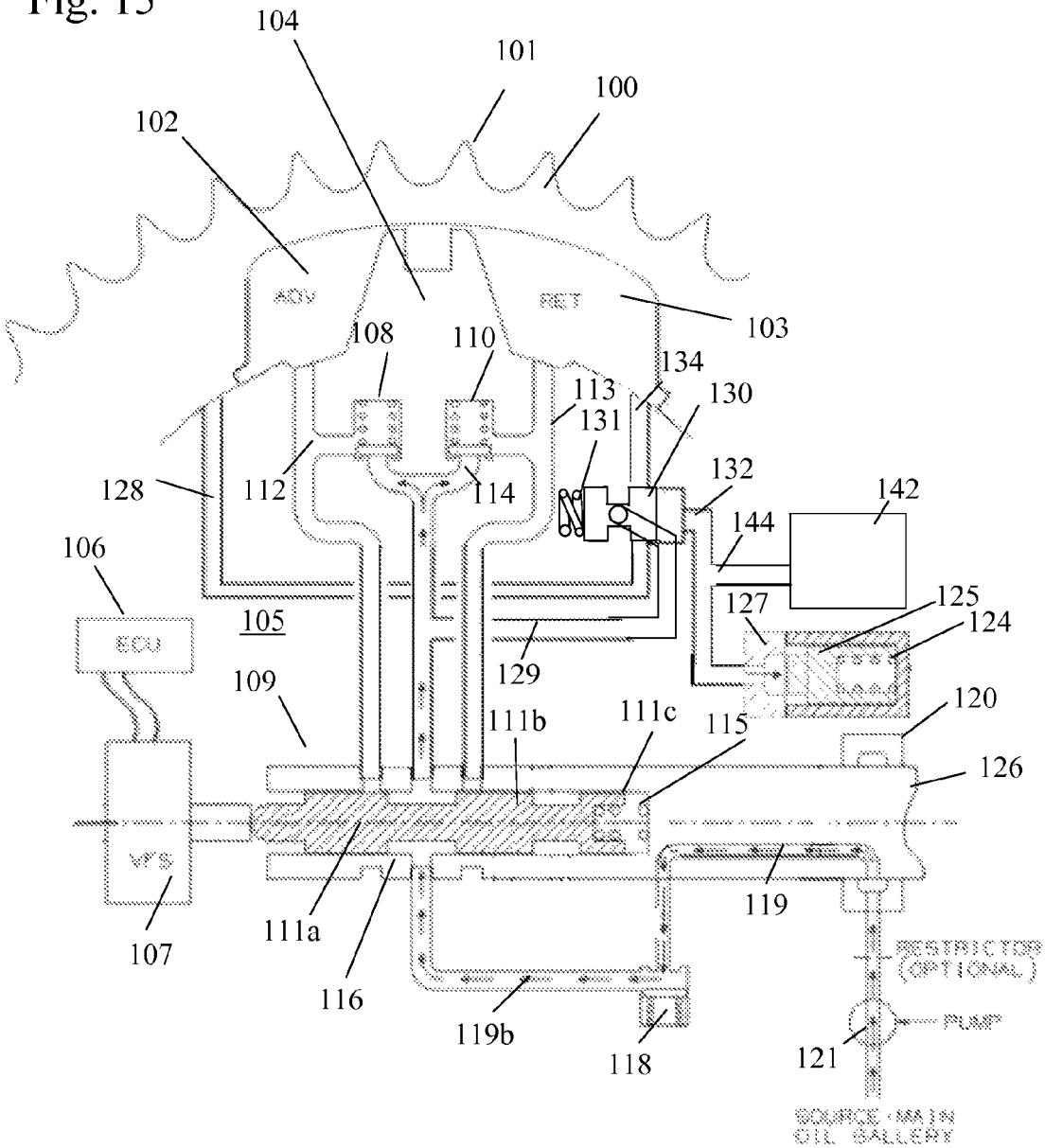
FIG. 15 shows a schematic of a fourth embodiment of the present invention, with the piloted valve in a first position, the phaser in the holding position, and the lock pin and the piloted valve are controlled by other hydraulic means.
Figure 16:
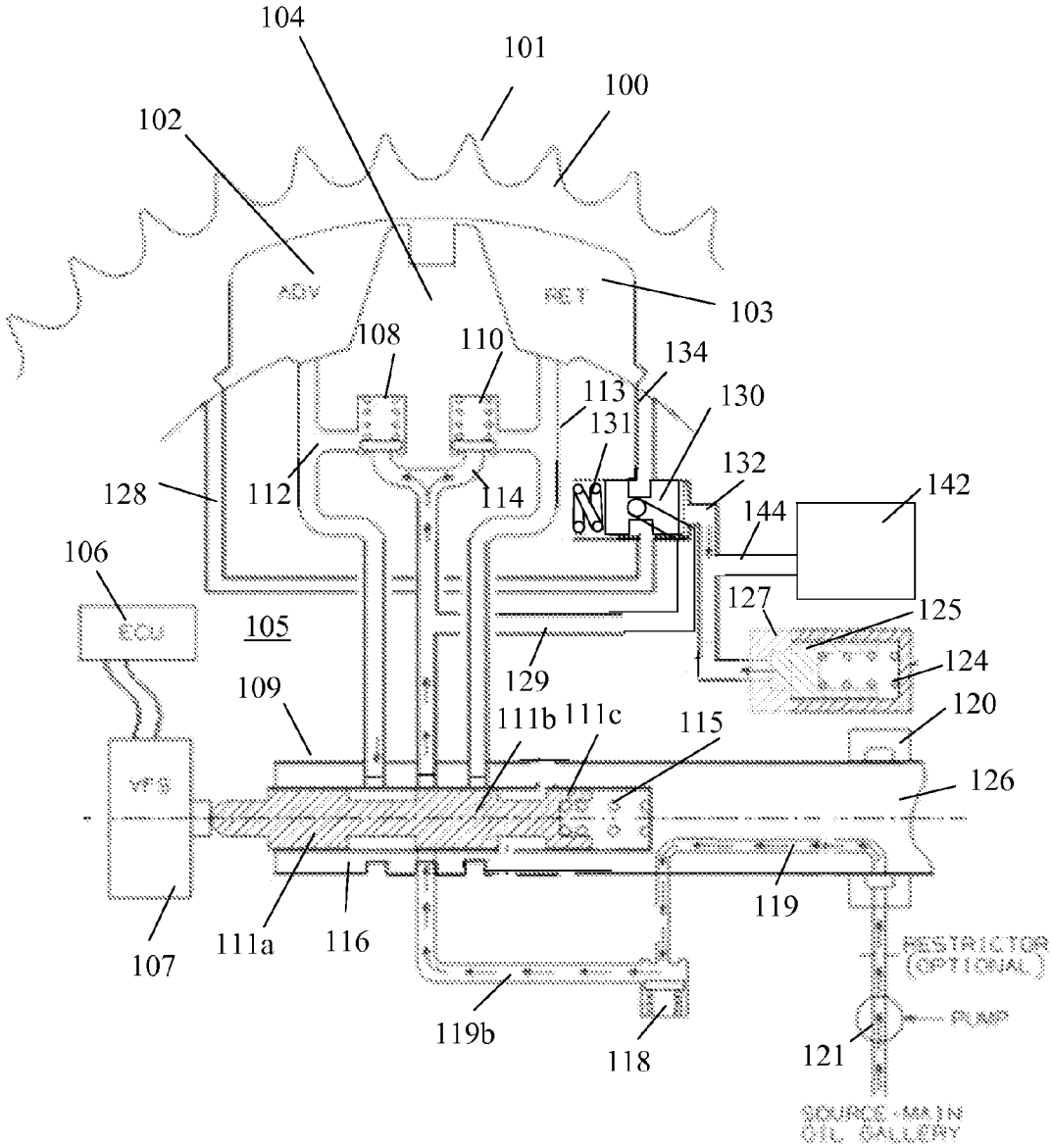
FIG. 16 shows a schematic of a fourth embodiment of the present invention, with the piloted valve in a second position, the phaser in the intermediate phase angle position, and the lock pin and the piloted valve are controlled by other hydraulic means.

FIGS. 15-16 show a fourth embodiment of the present invention in which the piloted valve 130, the hydraulic detent circuit 133 and the lock pin circuit 123 are controlled by a remote means 142. The remote means 142 may be any on/off hydraulic valve, for example a solenoid valve. Movement of the piloted valve is actively controlled by the remote means. FIG. 15 shows the phaser in the holding position and the control valve 109 in holding mode. FIG. 16 shows the control valve 109 in the detent mode and the hydraulic detent circuit 133*a* on. The advance mode and the retard mode are not shown, but are similar to FIGS. 1 and 2 of the first embodiment, where the hydraulic detent circuit is off The hydraulic detent circuit 133*a* includes a spring 131 loaded piloted valve 130 and an advance detent line 128 that connects the advance chamber 102 to the piloted valve 130 and the common line 114, and a retard detent line 134 that connects the retard chamber 103 to the piloted valve 130, the common line 114, and line 144 leading to the hydraulic means 142. In this embodiment, the lock pin circuit 123*a* includes the lock pin 125, line 132 connecting the lock pin to the piloted valve and line 144 leading to the hydraulic means 142.

Referring to FIG. 15, the duty cycle of the variable force solenoid 107 is 50% and the force of the NTS 107 on one end of the spool 111 equals the force of the spring 115 on the opposite end of the spool 111 in holding mode. The lands 111*a* and 111*b* block the flow of fluid to lines 112 and 113 respectively. Makeup oil is supplied to the phaser from supply S by pump 121 to make up for leakage and enters line 119 through a bearing 120. Line 119 leads to inlet check valve 118 and the control valve 109. From the control valve 109, fluid enters line 114 through either of the check valves 108, 110, depending on which is open to the chambers 102, 103. Fluid is supplied to the piloted valve 130 from hydraulic means 142. and pressurizes the piloted valve 130 against the spring 131, moving the piloted valve 130 to a position where retard detent line 134, advance detent line 128 and line 129 are blocked and the detent circuit is off. At the same time the pressure of the fluid in line 144 biases the lock pin 125 against the spring to a released position, filling the lock pin circuit 123*a*. The piloted valve 130, the lock pin circuit 123*a* and the detent circuit 133*a* are prevented from venting by the hydraulic means 142. In other words, the hydraulic means 142 is switched on and is providing fluid through line 144 to the piloted valve 130 and the lock pin 125 only.

FIG. 16 shows the phaser in the mid position or intermediate phase angle position, where the duty cycle of the variable force solenoid is 0%, the spool 109 is in detent mode, the piloted valve 130 and the lock pin 125 are vented through the hydraulic means 142 leading to exhaust, and the hydraulic detent circuit 133*a* is open.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0% and the rotor assembly 105 will move via the detent circuit to the mid position or intermediate phase angle position and the lock pin 125 would be engaged in mid position or intermediate phase angle position regardless of what position the vane 104 was in relative to the housing assembly 100 prior to the abnormal shut down of the engine. With the ability of the phaser of the present invention to default to a mid position or intermediate phase angle position without using electronic controls, allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the VFS on the spool 111 is decreased, and the spring 115 moves the spool 111 to the far left end of the spool's travel to a detent mode as shown in the FIG. 16. In the detent mode, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 to the inlet check valve 118 to the common line 114. Fluid is prevented from flowing from the hydraulic means 142 through line 144 and 132 to the piloted valve 130 and the lock pin 125 by the hydraulic means 142. In, other words, the hydraulic means 142 would be switched off, and allowing venting only. Therefore, the piloted valve 130 and the lock pin 125 vents to the hydraulic means through lines 144 and 132, opening passage between the advance detent line 128 and the retard detent line 134 through the piloted valve 130 to line 129 and the common line 114, in other words opening the hydraulic detent circuit 133*a*.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor 105 closes off the advance detent line 128 from the advance chamber 102, the vane 104 is moved to a mid position within the chamber formed between the housing assembly 100 and the rotor 105, and the lock pin 125 aligns with recess 127, locking the rotor assembly 105 relative to the housing assembly 100 in a mid position or an intermediate phase angle position.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor 105 closes off line the retard detent 134 from the retard chamber 103, the vane 104 is moved to an intermediate phase angle position or a mid position within the chamber formed between the housing assembly 100 and the rotor assembly 105, and the lock pin 125 aligns with the recess 127, locking the rotor 105 relative to the housing assembly 100 in a mid position or an intermediate phase angle position.

The phaser shown in the above Figures may also include a restrictor between the supply pump 121 and the supply line 119 entering the camshaft 126.

Figure 17A:
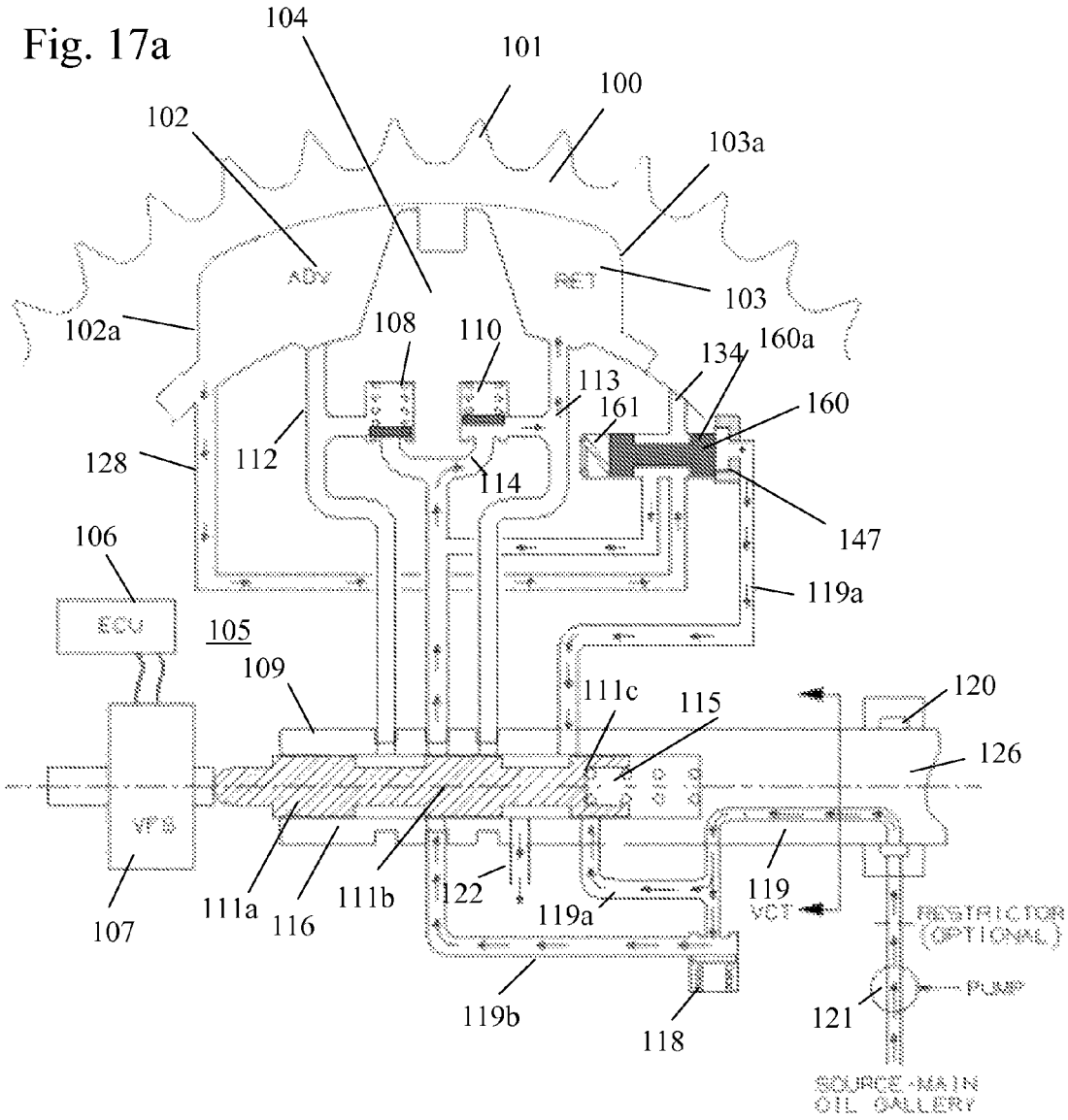
FIG. 17*a* shows a schematic of a fifth embodiment of the present invention, in which the lock pin is integrated into the piloted valve and the hydraulic detent lock circuit is open, the lock pin end portion is not engaged with the recess, and the phaser is moving via the detent circuit in the retard direction towards a locked position.
Figure 17B:
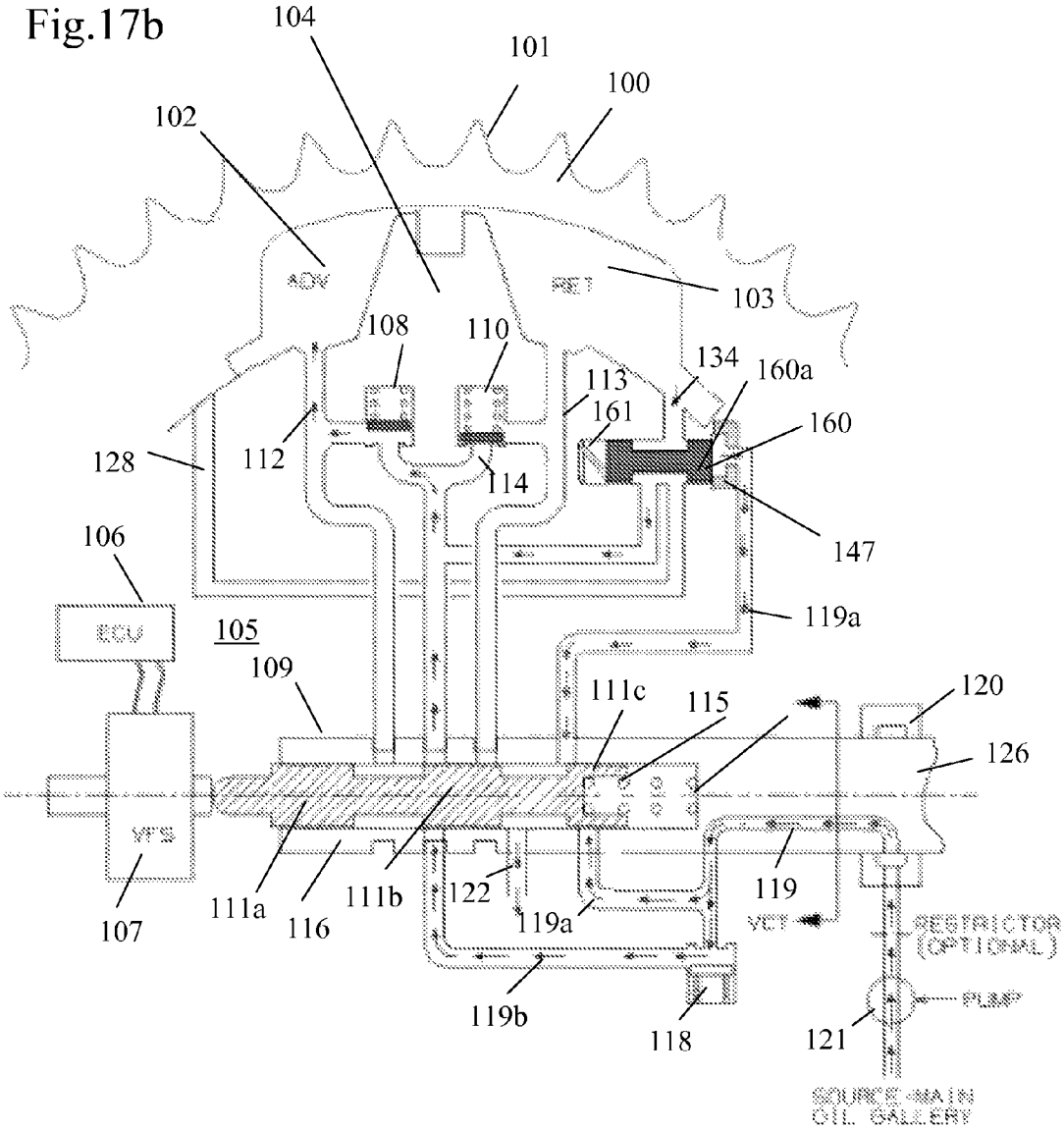
FIG. 17*b* shows a schematic of a fifth embodiment of the present invention. in which the lock pin is integrated into the piloted valve and the hydraulic detent lock circuit is open, the lock pin end portion is not engaged with the recess, and the phaser is moving via the detent circuit in the advance direction towards a locked position.
Figure 17C:
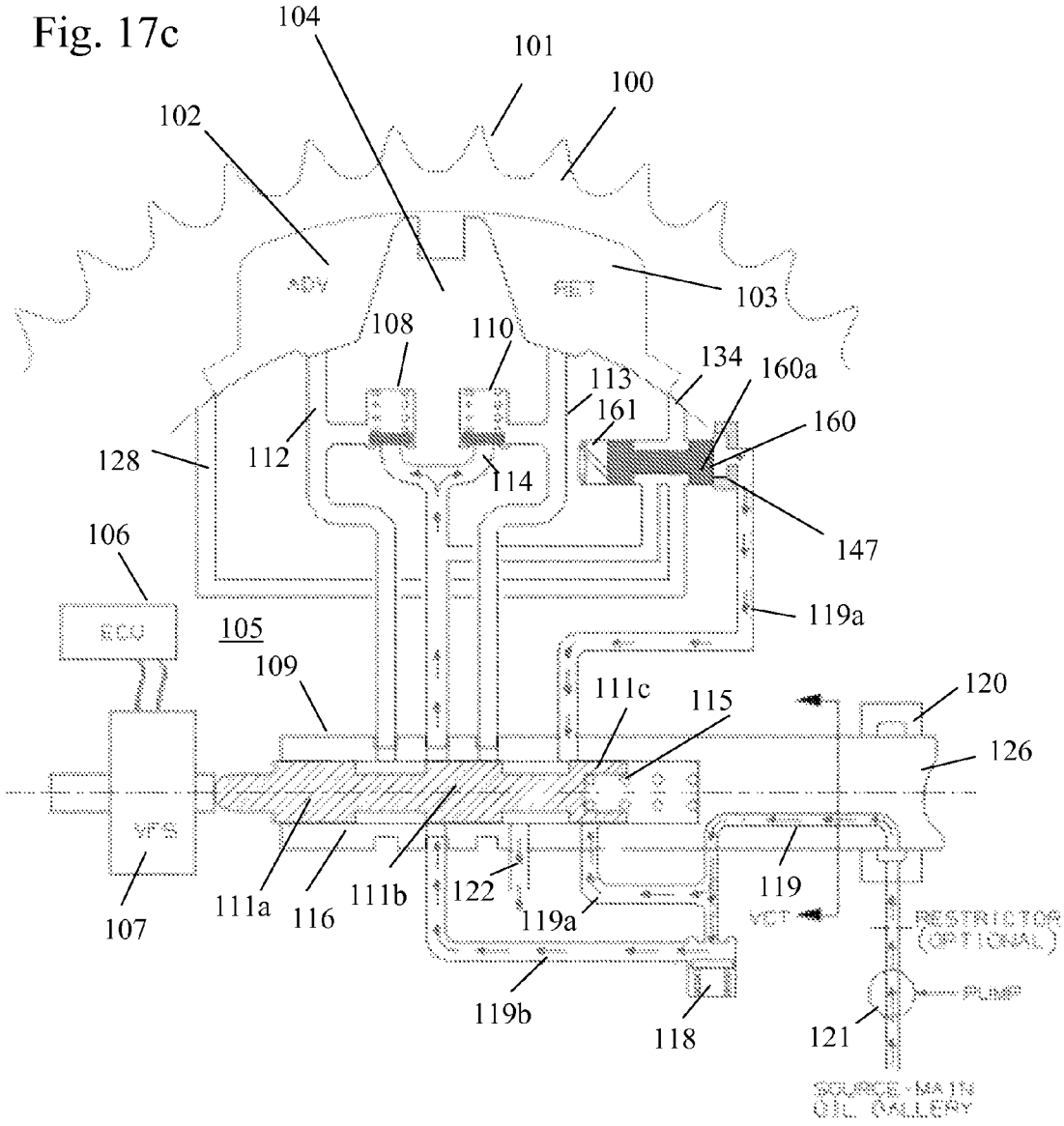
FIG. 17*c* shows a schematic of a fifth embodiment of the present invention in which the lock pin end portion is just about to align with and engage the recess.
Figure 18:
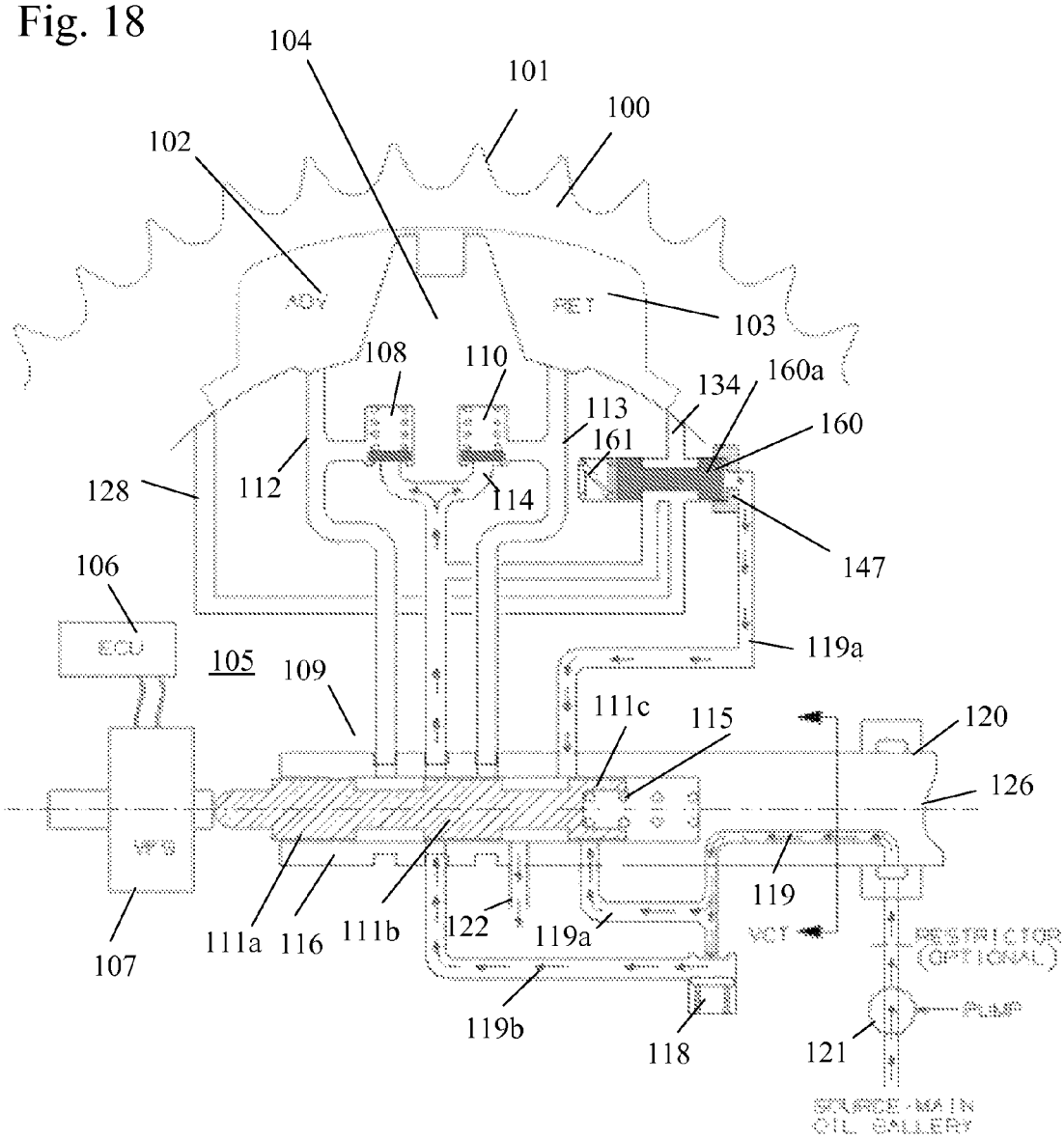
FIG. 18 shows another schematic of a fifth embodiment of the present invention in which lock pin is integrated into the piloted valve and the hydraulic detent lock circuit is open and the lock pin end portion is engaged with the recess.
Figure 19:
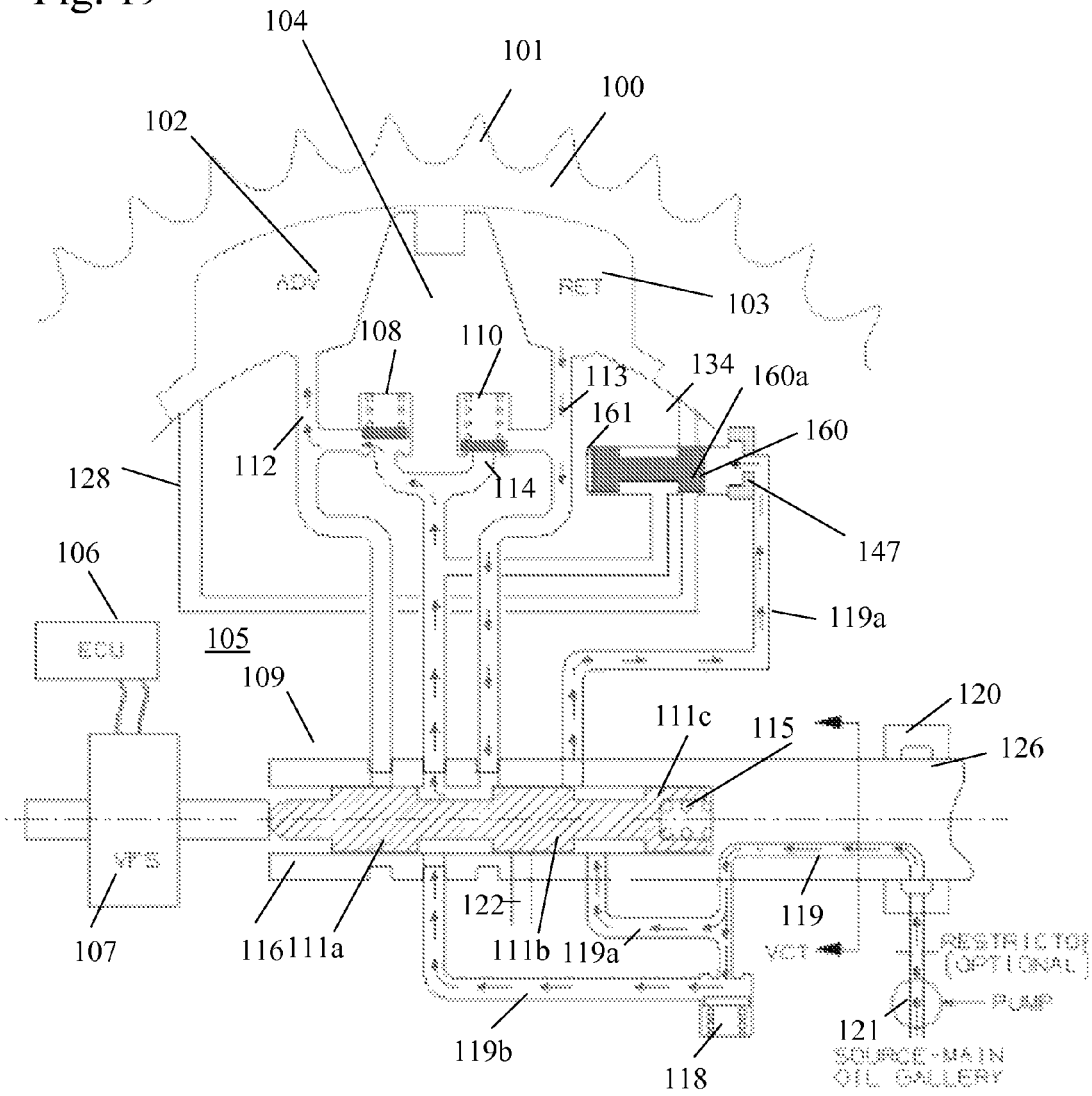
FIG. 19 shows a schematic of a fifth embodiment of the present invention in which the lock pin is integrated into the piloted valve and the hydraulic detent lock circuit is closed, the lock pin end portion is released from the recess, and the phaser is moving towards an advance position.
Figure 20:
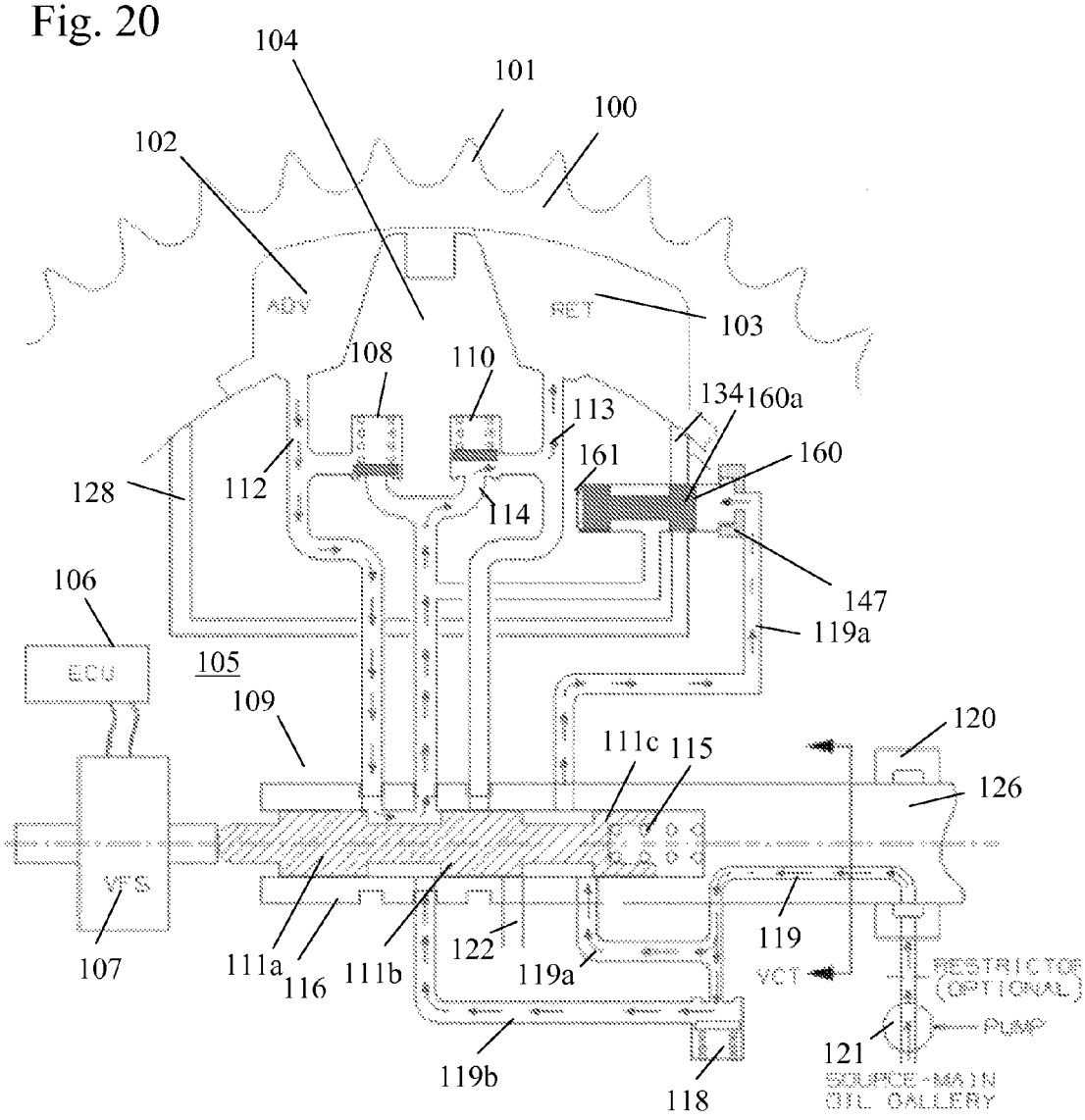
FIG. 20 shows a schematic of a fifth embodiment of the present invention in which the lock pin is integrated into the piloted valve and the hydraulic detent lock circuit is closed, the lock pin end portion is released from the recess, and the phaser is moving towards the retard position.

FIGS. 17*a*-20 show a fifth embodiment of the present invention with the lock pin integrated into the piloted valve to form a piloted lock valve. Movement of the piloted lock valve is actively controlled by the control valve of the phaser. FIG. 17*a* shows the phaser moving from an advance position towards a mid position or intermediate phase angle position by the open hydraulic detent lock circuit. FIG. 17*b* shows the phaser moving from a retard position towards a mid position or intermediate phase angle by the open hydraulic detent lock circuit. FIG. 17*c* shows the phaser just prior to the lock pin end of the piloted lock valve engaging the recess. FIG. 18 shows the phaser in the mid position or intermediate phase angle position with lock pin end of the piloted lock valve engaging the recess. FIG. 19 shows the phaser moving towards the advance position. FIG. 20 shows the phaser moving towards the retard position.

Torque reversals in the camshaft caused by the forces of opening and closing engine valves move the vane 104. The advance and retard chambers 102, 103 are arranged to resist positive and negative torque pulses in the camshaft 126 and are alternatively pressurized by the cam torque. The control valve 109 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force. The rotor assembly 105 is connected to the camshaft 126 and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent lock circuit 162 is also present. The hydraulic detent lock circuit 162 includes a spring 161 loaded piloted lock valve 160 and an advance detent line 128 that connects the advance chamber 102 to the piloted lock valve 160 and the common line 114, a retard detent line 134 that connects the retard chamber 103 to the piloted lock valve 160 and the common line 114, and line 129 that connects the piloted lock valve 160 to the common line 114. The advance detent line 128 and the retard detent line 134 are a predetermined distance or length from the vane 104. The piloted lock valve 160 is in the rotor assembly 105 and is fluidly connected to line 119*a* and exhaust line 122. The piloted lock valve 160 also has an end that functions as a lock pin. One end portion of the valve 160 is the lock pin end portion 160*a* and is biased towards and fits into a recess 147 in the housing assembly 100 by spring 161.

Alternatively, the piloted lock valve 160 may be housed in the housing assembly 100 and be spring 161 biased towards a recess 147 in the rotor assembly 105. The opening and closing of the hydraulic detent lock circuit 162 is controlled by the switching/movement of the phase control valve 109. A phase control valve 109, preferably a spool valve, includes a spool 111 with cylindrical lands 111*a*, 111*b*, and 111*c* slidably received in a sleeve 116 within a bore in the rotor 105 and pilots in the camshaft 126. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent lock circuit 162 is open (on) or closed (off) and whether the lock pin end portion 160*a* of the piloted lock valve 160 is received by the recess 147 (locked) or not received by the recess 147 (unlocked). The control valve 109 has an advance mode, a retard mode, a null mode, and a detent mode. In the advance mode, the spool 111 is moved to a position so that fluid may flow from the retard chamber 103 through the spool 111 to the advance chamber 102, fluid is blocked from exiting the advance chamber 102, and the hydraulic detent lock circuit 162 is off or closed. In other words, the piloted lock valve 160 blocks fluid from flowing between lines 134 and 128 and the lock pin end portion 160*a* of the valve 160 does not engage the recess 147. In the retard mode, the spool 111 is moved to a position so that fluid may flow from the advance chamber 102 through the spool 111 to the retard chamber 103, fluid is blocked from exiting the retard chamber 103, and the hydraulic detent lock circuit 162 is off. In other words, the piloted lock valve 160 blocks fluid from flowing between lines 134 and 128 and the lock pin end portion 160*a* of the valve does not engage the recess 147. In the null mode of the control valve, the lock pin end portion 160*a* of the piloted lock valve 160 engages the recess 147, moving the piloted lock valve 160 to a position in which line 128 and 134 are connected to each other through the piloted lock valve 160, and the hydraulic detent lock circuit 162 is on. In the detent mode or when the hydraulic detent lock circuit 162 is on, three functions occur simultaneously. The first function in the detent mode is that the spool 111 moves to a position in which all spool land 111*b* blocks the flow of fluid from line 112 in between spool lands 111*a* and 111*b* from entering any of the other lines and line 113, effectively removing control of the phase from the control valve 109 A continuous supply of makeup oil is provided to the phaser through an annulus on the outer diameter of the sleeve surrounding the spool. The second function in detent mode is to open or turned on the hydraulic detent lock circuit 162. The hydraulic detent lock circuit 162 has complete control over the phaser moving to advance or retard, until the vane 104 reaches the intermediate phase angle position shown in FIG. 18 when the lock pin end portion 160*a* of the piloted lock valve 160 mates with the recess 147. The third function in the detent mode is to vent the fluid in line 119*a* leading to the lock pin end portion 160*a* of the piloted lock valve 160, allowing the lock pin end portion 160*a* to the engage the recess 147. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 30%, 50% or 100%, the spool 111 will be moved to positions that correspond with the retard mode, the holding mode, and the advance mode, respectively and the piloted lock valve 160 will be pressurized and move to the second position, the hydraulic detent lock circuit 162 will be closed, and the lock pin end portion 160*a* will be pressurized and released from the recess 147. When the duty cycle of the variable force solenoid 107 is 0%, the spool 111 is moved to the detent mode such that the piloted lock valve 160 vents and moves to a position in which the hydraulic detent lock circuit 162 will be open, and line 119*a* leading to the lock pin end portion 160*a* is vented and the lock pin end portion 160*a* mates with the recess 147. A duty cycle of 0% was chosen as the extreme position along the spool stroke to open the hydraulic detent lock circuit 160, vent the piloted lock valve 160, and vent and engage the lock pin end portion 160*a* with the recess 147, since if power or control is lost, the phaser will default to a locked position. It should be noted that the duty cycle percentages listed above are an example and they may be altered. Furthermore, the hydraulic detent lock circuit 162 may be open, the piloted lock valve 160 vented, and the lock pin end portion 160*a* vented and engaged with the recess 147 at 100% duty cycle, if desired.

FIG. 19 shows the phaser moving towards the advance position. To move towards the advance position, the duty cycle is increased to greater than 50% and up to 100%, the force of the VFS 107 on the spool 111 is increased and the spool 111 is moved to the right by the VFS 107 in an advance mode, until the force of the spring 115 balances the force of the VFS 107. In the advance mode shown, spool land 111*a* blocks line 112 and lines 113 and 114 are open. Camshaft torque pressurizes the retard chamber 103, causing fluid to move from the retard chamber 103 and into the advance chamber 102, and the vane 104 to move. Fluid exits from the retard chamber 103 through line 113 to the control valve 109 between spool lands 111*a* and 111*b* and recirculates back to central line 114 and line 112 leading to the advance chamber 102.

Makeup oil is supplied to the phaser from supply S by pump 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 through either of the check valves 108,110, depending on which is open to the chambers 102, 103.

Line 119*a* leads to the piloted lock valve 160. The pressure of the fluid in line 1119*a* moves through the spool 111 between lands 111*b* and 111*c* to bias the piloted lock valve 160 against the spring 161 to a position in which the lock pin end portion 160*a* is released, and at the same time, pressurizes the piloted lock valve 160 against the spring 161, moving the piloted lock valve 160 to a position where retard detent line 134 and advance detent line 128 are blocked as shown and the hydraulic detent lock circuit is off. Exhaust line 122 is blocked by spool land 111*b*, preventing the piloted lock valve 160 from venting.

FIG. 20 shows the phaser moving towards the retard position. To move towards the retard position, the duty cycle is changed to greater than 30% but less than 50%, the force of the VFS 107 on the spool 111 is reduced and the spool 111 is moved to the left in a retard mode in the figure by spring 115, until the force of spring 115 balances the force of the VFS 107. In the retard mode shown, spool land 111*b* blocks line 113 and lines 112 and 114 are open. Camshaft torque pressurizes the advance chamber 102, causing fluid in the advance chamber 102 to move into the retard chamber 103, and the vane 104 to move. Fluid exits from the advance chamber 102 through line 112 to the control valve 109 between spool lands 111*a* and 111*b* and recirculates back to central line 114 and line 113 leading to the retard chamber 103.

Makeup oil is supplied to the phaser from supply S by pump 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 through either of the check valves 108, 110, depending on which is open to the chambers 102, 103.

Line 119*a* leads to the piloted lock valve 160. The pressure of the fluid in line 119*a* moves through the spool 111 between lands 111*b* and 111*c* to bias the piloted lock valve 160 against the spring 161 to a position in which the lock pin end portion 160*a* of the piloted lock valve is not engaged with the recess 147 and at the same time, pressurizes the piloted lock valve 160 against the spring 161, moving the piloted lock valve 160 to a position where retard detent line 134 and advance detent line 128 are blocked as shown and the detent circuit is off Exhaust line 122 is blocked by spool land 111*b*, preventing the piloted lock valve 160 from venting.

FIG. 17*a* shows the hydraulic detent lock circuit 162 open, with the phaser moving under the control of the hydraulic detent lock circuit in a retard direction toward a position in which the lock pin end portion 160*a* of the piloted lock valve 160 will align with the recess 147. FIG. 17*b* shows the hydraulic detent lock circuit open with the phaser moving under the control of the hydraulic detent lock circuit 162 in an advance direction toward a position in which the lock pin end portion 160*a* of the piloted valve 160 will align with the recess 147. FIG. 17*c* shows the hydraulic detent lock circuit open, with the lock pin end portion 160*a* just about aligned with the recess 147.

When the duty cycle of the variable force solenoid 107 is just set to 0%, the force on the NTS on the spool 111 is decreased, and the spring 115 moves the spool 111 to the far left end of the spool's travel to a detent mode as shown in the FIGS. 17*a*-17*c*. In the detent mode, spool lands 111*a* and 111*b* blocks the flow of fluid from line 112 in between spool lands 111*a* and 111*b* from entering any of the other lines and line 113, effectively removing control of the phaser from the control valve 109. At the same time, fluid from supply may flow through line 119 through the inlet check valve 118 to the common line 114 through an annulus on the outer diameter of the sleeve of the control valve 109. Fluid in line 119*a* leading to the piloted lock valve 160 is vented, and spring 161 moves the piloted lock valve 160 towards the recess 147, opening the hydraulic detent lock circuit 162. The movement of the piloted lock valve 160 is limited by whether the recess 147 is aligned with the lock pin end portion 160*a* of the piloted lock valve 160. If the recess 147 is not aligned with the lock pin end portion 160*a* of the piloted lock valve 160, then phaser is solely controlled by the hydraulic detent lock circuit 162, especially the fluid in lines 128 and 134. Once the recess 147 aligns with the lock pin end portion 160*a* of the piloted lock valve 160, the spring 161 moves the piloted lock valve 160 to engage the recess 147, locking the phaser in position as shown in FIG. 18.

If the vane 104 was positioned within the housing assembly 100 near or in the advance position and the advance detent line 128 is exposed to the advance chamber 102, as shown in FIG. 17*a*, then fluid from the advance chamber 102 will flow into the advance detent line 128 and through the open piloted valve 160 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to a mid position or intermediate phase angle position within the chamber formed between the housing assembly 100 and the rotor assembly 105 as shown in FIG. 17*c*.

If the vane 104 was positioned within the housing assembly 100 near or in the retard position and the retard detent line 134 is exposed to the retard chamber 103, as shown in FIG. 17*b*, then fluid from the retard chamber 103 will flow into the retard detent line 134 and through the open piloted valve 160 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes offline the retard detent 134 from the retard chamber 103, the vane 104 is moved to a mid position or intermediate phase angle position within the chamber formed between the housing assembly 100 and the rotor assembly 105 as shown in FIG. 17*c*.

FIG. 17*c* shows the phaser right before the recess 147 aligns with the lock pin end portion 160*a* of the piloted lock valve 160. In this position, spool lands 111*a* and 111*b* blocks the flow of fluid from line 112 in between spool lands 111*a* and 111*b* from entering any of the other lines and line 113, effectively removing control of the phaser from the control valve 109. At the same time, fluid from supply may flow through line 119 through the inlet check valve 118 to the common line 114 through an annulus on the outer diameter of the sleeve of the control valve 109. Fluid in line 119*a* leading to the piloted lock valve 160 is vented, and spring 161 moves the piloted lock valve 160 towards the recess 147, opening the hydraulic detent lock circuit 162.

FIG. 18 shows the phaser in detent mode with the lock pin end portion 160*a* of the piloted lock valve 160 engaged with the recess 147. In this position, the duty cycle of the variable force solenoid 107 is 0% and the force of the VFS 107 on one end of the spool 111 equals the force of the spring 115 on the opposite end of the spool 111 in detent mode. Land 111*b* blocks the flow of fluid to and from lines 113 and 114. Makeup oil is supplied to the phaser from supply S by pump 121 to make up for leakage and enters line 119 through a bearing 120. Line 119 splits into two lines 119*a* and 119*b*. Line 119*b* leads to inlet check valve 118 and the control valve 109. From line 119*b*, fluid enters an annulus in the outer diameter of the sleeve of the control valve and enters line 114 through either of the check valves 108, 110, depending on which is open to the chambers 102, 103. Line 119*a* leads to the lock pin end portion 160*a* of the piloted lock valve 160. Fluid in line 112 is blocked by the spool 111 and the lands 111*a* and 111*b* from exiting the control valve 109 and the advance chamber 102. Fluid in line 119*a* vents from the piloted lock valve 160 through line 119*a* and between lands 111*b* and 111*c* to line 122 leading to sump. By venting the fluid in line 119*a*, the force of the spring 161 on the piloted lock valve 160 moves the valve such that the lock pin end portion 160*a* engages the recess 147.

A holding position is also present and is similar to the phaser position shown in FIG. 3.

In all of the above embodiments, the piloted valve or piloted lock valve is actively controlled by a remote means such as an on/off valve or the control valve of the phaser.

Accordingly, it is to be understood that the embodiments of the invention herein described are merely illustrative of the application of the principles of the invention. Reference herein to details of the illustrated embodiments is not intended to limit the scope of the claims. which themselves recite those features regarded as essential to the invention.

What is claimed is:

1. A variable cam timing phaser for an internal combustion engine including a housing assembly with an outer circumference for accepting drive force and a rotor assembly for connection to a camshaft, coaxially located within the housing having a plurality of vanes, wherein the housing assembly and the rotor assembly define at least one chamber separated by a vane into an advance chamber and a retard chamber, the vane within the chamber acting to shift relative angular position of the housing assembly and the rotor assembly, comprising:

a piloted valve in the rotor assembly, movable from a first position to a second position, and detent lines communicating with the advance chamber or the retard chamber are restricted and or blocked when the rotor assembly is in or near an intermediate phase angle position;

wherein when the piloted valve is in the first position, fluid is blocked from flowing through the piloted valve and wherein when the piloted valve is in a second position, fluid is allowed to flow between the detent line from the advance chamber and the detent line from the retard chamber through the piloted valve and a common line, such that the rotor is moved to and held in the intermediate phase angle position relative to the housing.

2. The phaser of claim 1, wherein the piloted valve is moved to the first position by hydraulic pressure.

3. The phaser of claim 2, wherein the hydraulic pressure is controlled by a remote on/off valve.

4. The phaser of claim 2, wherein the hydraulic pressure is controlled by a control valve for the phaser.

5. The phaser of claim 1, wherein the piloted valve is spring biased to the second position.

6. The phaser of claim 1, further comprising a lock pin slidably located in the rotor assembly or the housing assembly, the lock pin being moveable in the rotor assembly or housing assembly from a locked position in which an end portion engages a recess, locking the relative angular position of the housing assembly and the rotor assembly, to an unlocked position, in which the end portion does not engage the recess.

7. The phaser of claim 6, wherein the lock pin is formed as part of the piloted valve.

8. The phaser of claim 6, wherein the lock pin is movable from a locked position to an unlocked position by a hydraulic pressure.

9. The phaser of claim 8, wherein the hydraulic pressure is controlled by an on/off valve.

10. The phaser of claim 8, wherein the hydraulic pressure is controlled by a control valve for the phaser.

11. The phaser of claim 1, further comprising a control valve for controlling the position of the vane in the chamber, through an advance line, a retard line, a common line, an advance detent line and a retard detent line, the control valve being movable into an advance mode, a holding position, a retard mode, and a detent mode, wherein the control valve causes the pilot valve to move to the second position.

12. A variable cam timing phaser for an internal combustion engine, comprising:

a housing assembly with an outer circumference for accepting drive force;

a rotor assembly for connection to a camshaft coaxially located within the housing assembly having a plurality of vanes, wherein the housing assembly and the rotor assembly define at least one chamber separated by a vane into an advance chamber and a retard chamber, the vane within the chamber acting to shift relative angular position of the housing assembly and the rotor assembly; and a control valve for directing fluid to and from the chambers through an advance line, a retard line, a common line, an advance detent line and a retard detent line, the control valve being movable in a first bore towards an advance mode, a holding position, a retard mode, and a detent mode;

a lock pin slidably located in the rotor assembly or the housing assembly, the lock pin being moveable in the second bore from a locked position in which an end portion engages the recess, locking the relative angular position of the housing assembly and the rotor assembly, to an unlocked position, in which the end portion does not engage the recess;

a piloted valve in the rotor assembly, movable from a first position to a second position, and the advance detent line and the retard detent line communicating with the advance chamber or the retard chamber are restricted and or blocked when the rotor assembly is in or near an intermediate phase angle position, wherein when the piloted valve is in the first position, fluid is blocked from flowing through the piloted valve and wherein when the piloted valve is in a second position, fluid is allowed to flow between the advance detent line from the advance chamber and the retard detent line from the retard chamber through the piloted valve and a common line, such that the rotor is moved to and held in the intermediate phase angle position relative to the housing;

wherein when the control valve is moved towards the advance mode or the retard mode, or in the holding position, the lock pin moves to the unlocked position and the piloted valve is moved to the first position, blocking the flow of fluid between the advance chamber and the retard chamber through the piloted valve;

wherein when the control valve is moved to the detent mode, the piloted valve is moved to the second position, the advance detent line or the retard detent line are in fluid communication with the common line through the piloted valve, the rotor assembly is moved to and held in an intermediate phase angle position relative to the housing assembly, and the lock pin is moved to a locked position.

13. The phaser of claim 12, wherein the lock pin is spring biased towards the locked position.

14. The phaser of claim 12, wherein the lock pin is formed as part of the piloted valve.

15. The phaser of claim 12, wherein the control valve is movable towards the advance mode, the retard mode, the detent mode, and to the holding position by a variable force solenoid.

16. The phaser of claim 12, wherein the control valve is at an extreme end of travel when the piloted valve is in the second position.

17. The phaser of claim 12, wherein the common line further comprises check valves.

18. The phaser of claim 12, wherein the lock pin is in the housing assembly and the recess is in the rotor assembly.

19. The phaser of claim 12, wherein the lock pin is in the rotor assembly and the recess is in the housing assembly.

20. The phaser of claim 12, wherein when the phaser is in the intermediate phase angle position, the advance detent line and the retard detent line are blocked by the housing assembly.

21. The phaser of claim 12, wherein when the phaser is in the intermediate phase angle position, the advance detent line and the retard detent line are at least partially restricted by the housing assembly.

22. The phaser of claim 12, wherein when the control valve is moved to the detent mode, the control valve causes the pilot valve to move to the second position.

23. A variable cam timing phaser for an internal combustion engine including a housing assembly with an outer circumference for accepting drive force and a rotor assembly for connection to a camshaft, coaxially located within the housing having a plurality of vanes, wherein the housing assembly and the rotor assembly define at least one chamber separated by a vane into an advance chamber and a retard chamber, the vane within the chamber acting to shift relative angular position of the housing assembly and the rotor assembly, comprising:

a piloted lock valve in the rotor assembly, movable from a first position to a second position, and detent lines communicating with the advance chamber or the retard chamber are restricted and or blocked when the rotor assembly is in or near an intermediate phase angle position comprising a lock pin end portion;

wherein when the piloted valve is in the first position, fluid is blocked from flowing through the piloted valve and wherein when the piloted valve is in a second position, fluid is allowed to flow between the detent line from the advance chamber and the detent line from the retard chamber through the piloted valve and a common line, such that the rotor is moved to and held in the intermediate phase angle position relative to the housing and the lock pin end portion of the piloted lock valve engages a recess in the housing, locking the relative angular position of the housing assembly and the rotor assembly.

24. The phaser of claim 23, wherein the piloted lock valve is moved to the first position by hydraulic pressure.

25. The phaser of claim 24, wherein the hydraulic pressure is controlled by a control valve for the phaser.

26. The phaser of claim 23, wherein the piloted valve is spring biased to the second position.

27. The phaser of claim 23, further comprising a control valve for controlling the position of the vane in the chamber, through an advance line, a retard line, a common line, an advance detent line, and a retard detent line, the control valve being movable into an advance mode, a retard mode, a detent mode, and a holding mode, wherein the control valve causes the pilot valve to move to the second position.

* * * * *

UNITED STATES PATENT AND TRADEMARK OFFICE

CERTIFICATE OF CORRECTION

PATENT NO. : 8,356,583 B2
APPLICATION NO. : 12/921425
DATED : January 22, 2013
INVENTOR(S) : Franklin R. Smith It is certified that error appears in the above-identified patent and that said Letters Patent is hereby corrected as shown below:

Title page, under item [60]: Delete the number “2009” and add the number “2008”.

Signed and Sealed this
Thirtieth Day of April, 2013

Teresa Stanek Rea
*Acting Director of the United States Patent and Trademark Office*